United States Patent [19]

Ichinose

[11] 4,079,674

[45] Mar. 21, 1978

[54] AUTOMATIC SCREEN PRINTING METHOD AND APPARATUS

[76] Inventor: Shiro Ichinose, 11-8, 4-chome, Shinohara, Kita, Nada, Kobe, Hyogo, Japan

[21] Appl. No.: 695,400

[22] Filed: Jun. 14, 1976

[51] Int. Cl.[2] ..... B41M 1/12; B41F 15/10

[52] U.S. Cl. ..... 101/129; 101/115; 101/123; 101/126

[58] Field of Search ..... 101/115, 116, 123, 124, 101/126, 129

[56] References Cited

U.S. PATENT DOCUMENTS

| | | | |
|---|---|---|---|
| 2,624,276 | 1/1953 | Klopfenstein | 101/123 |
| 2,845,859 | 8/1958 | Gattuso | 101/126 |
| 3,229,627 | 1/1966 | Pollitt | 101/115 |

FOREIGN PATENT DOCUMENTS

| | | | |
|---|---|---|---|
| 559,629 | 3/1975 | Switzerland | 101/115 |

*Primary Examiner*—Ronald E. Suter
*Attorney, Agent, or Firm*—Sherman & Shalloway

[57] ABSTRACT

Continuous, automatic printing of ordinary fabrics and cloths and screen printing of papers, films, metal foils and metal sheets is disclosed. Printing is accomplished by contacting a squeegee member, to which the printing paste or ink has been applied, with the material to be printed through a flat screen (stencil).

The material to be printed is fed continuously at a constant speed in a supported state to a printing operation zone. The flat screen is reciprocated in the longitudinal direction at the same speed and in the same direction and in contact with the material to be printed. The squeegee is scanned from one end of the flat screen to the other to effect the printing operation. The contact between the flat screen and material to be printed is released just before the squeegee member arrives at the other end of the screen. The screen and squeegee member are then moved to their original position so that the operation may be repeated.

The flat screen and squeegee member are driven by a common drive source and the operations of transporting the material to be printed, the flat screen and squeegee member as well as the operations of contacting and breaking the contact between the flat screen and material to be printed are performed according to a mechanically controlled program.

By performing the operations of acceleration speed reduction or stopping, positively according to the mechanically controlled program, generation of mechanical shocks are avoided and accurate multicolor repeated patterns can be printed.

6 Claims, 24 Drawing Figures

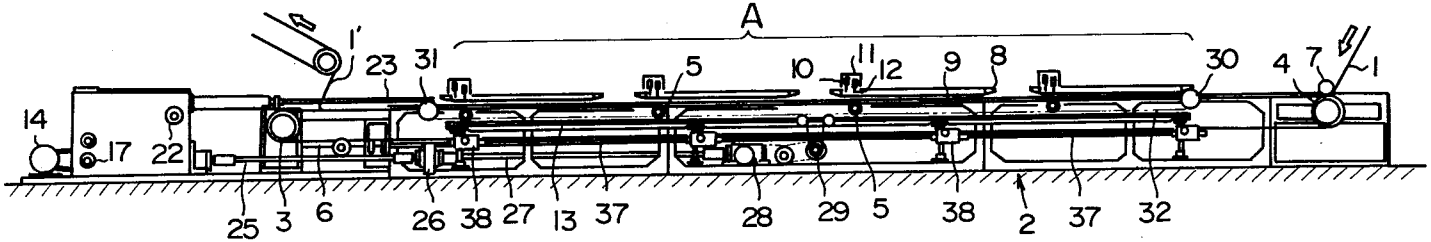
Fig. 1-A
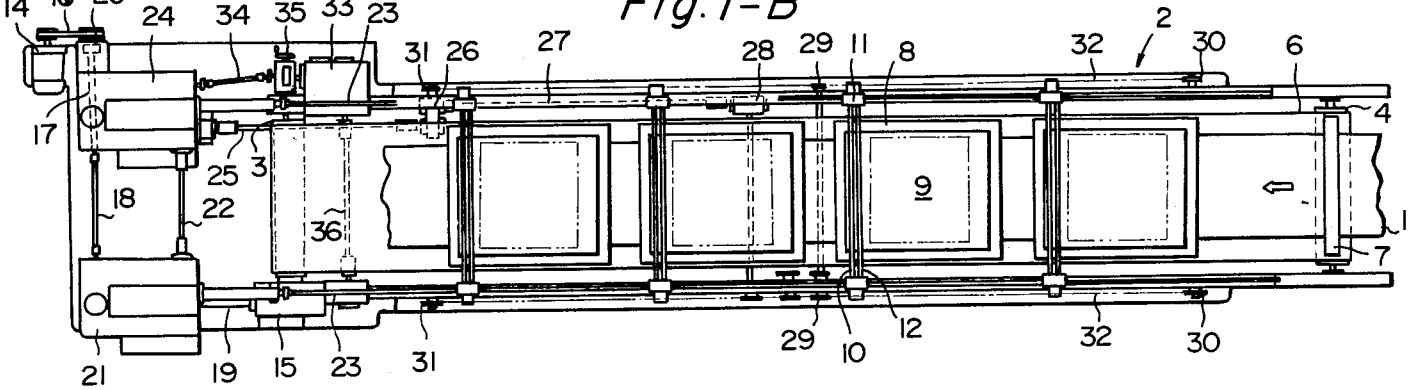
Fig. 1-B

Fig. 2-A
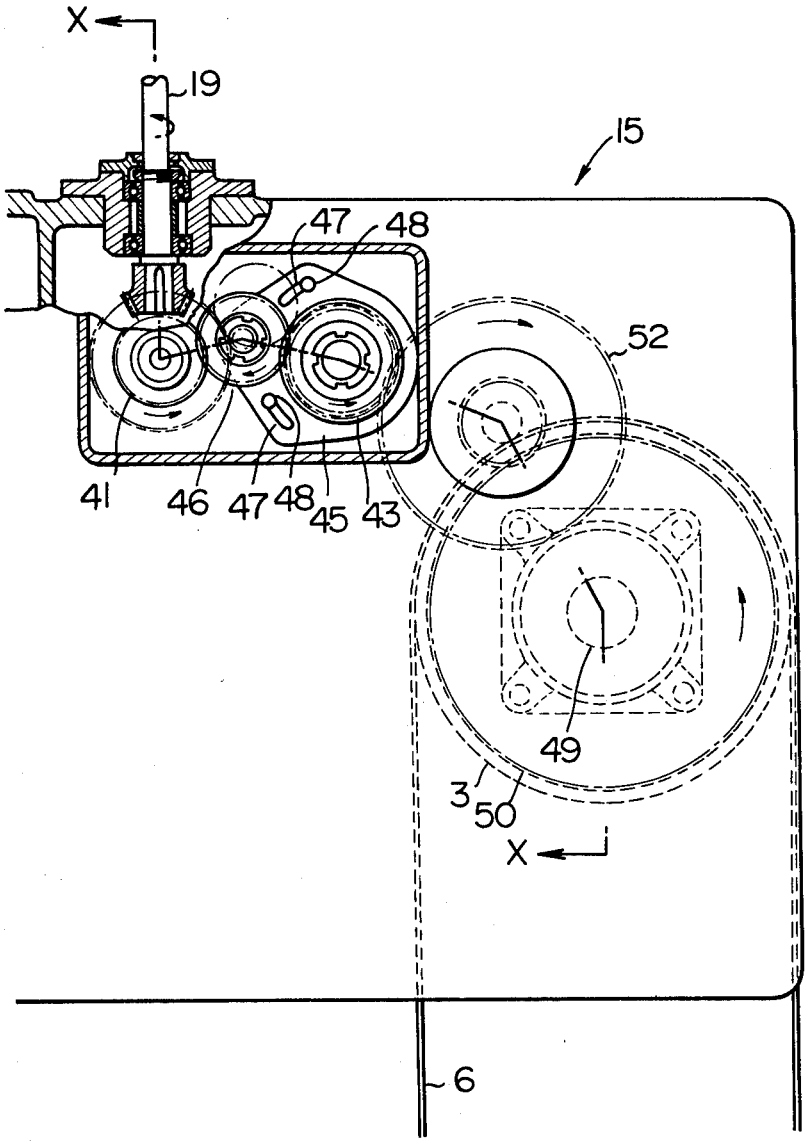

Fig. 2-B
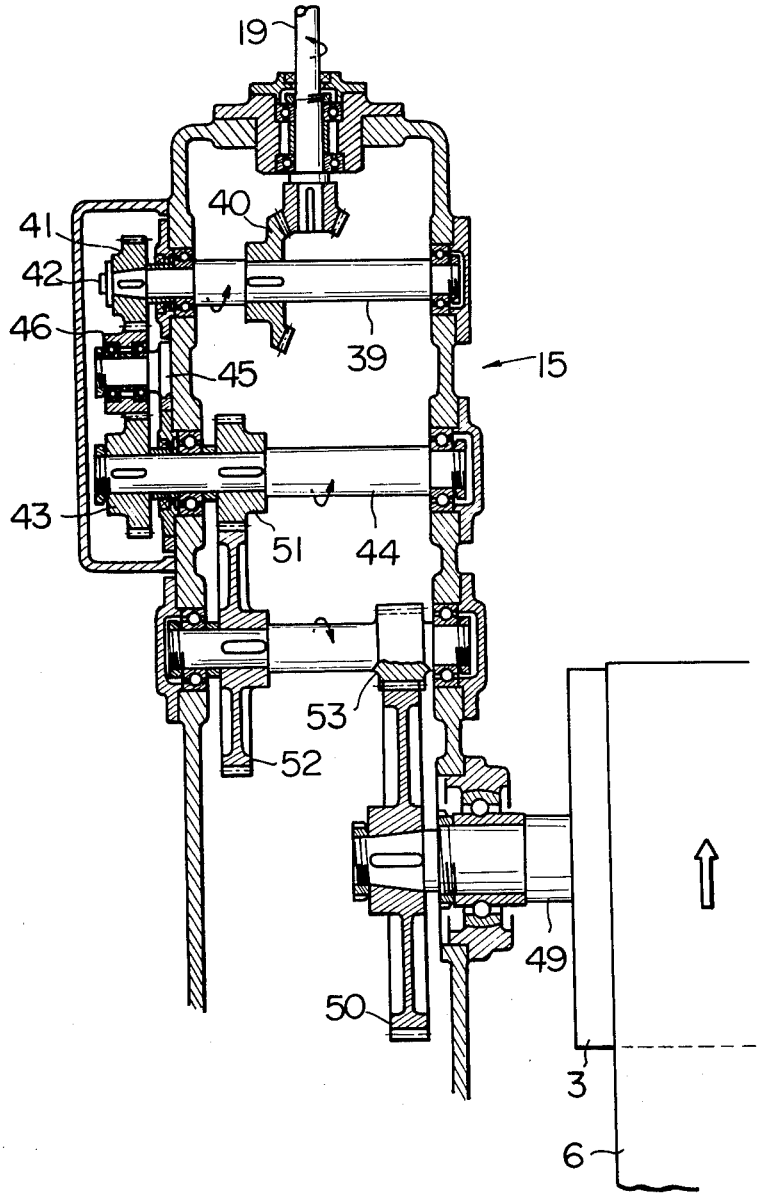

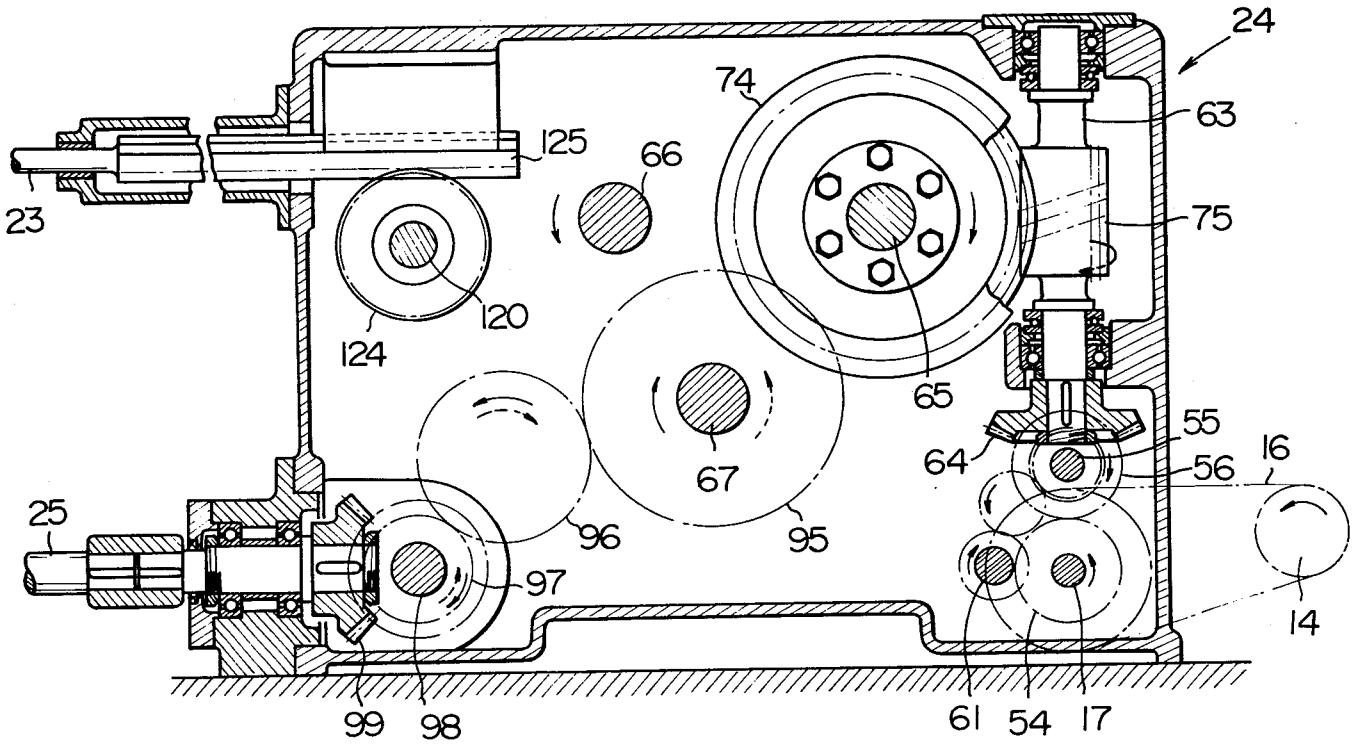
Fig. 4-A

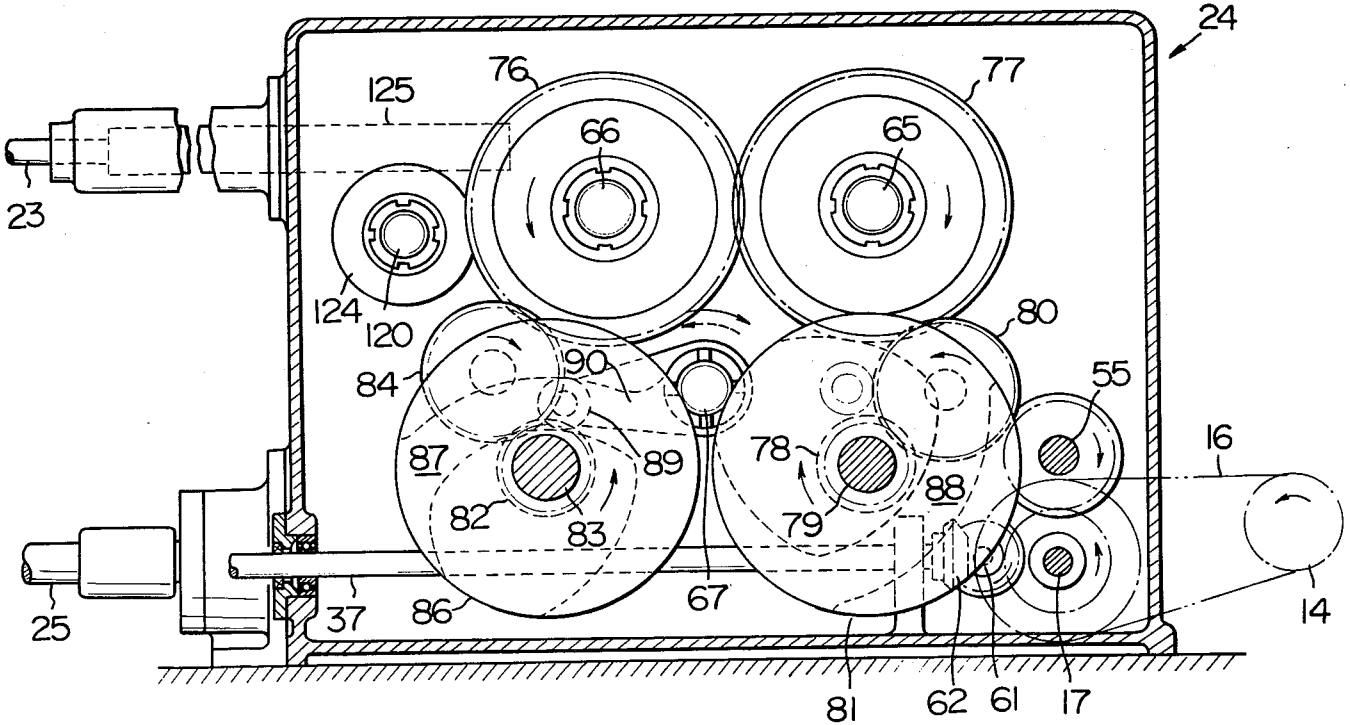
Fig. 4-B

Fig. 4-C
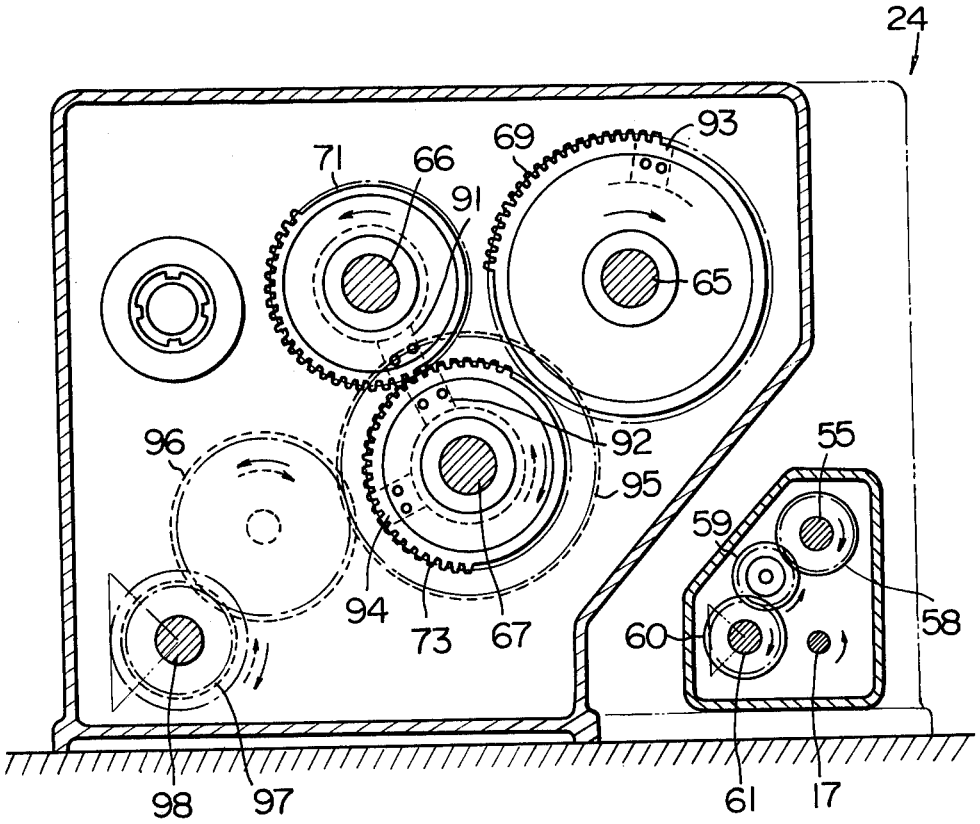

Fig. 5-A
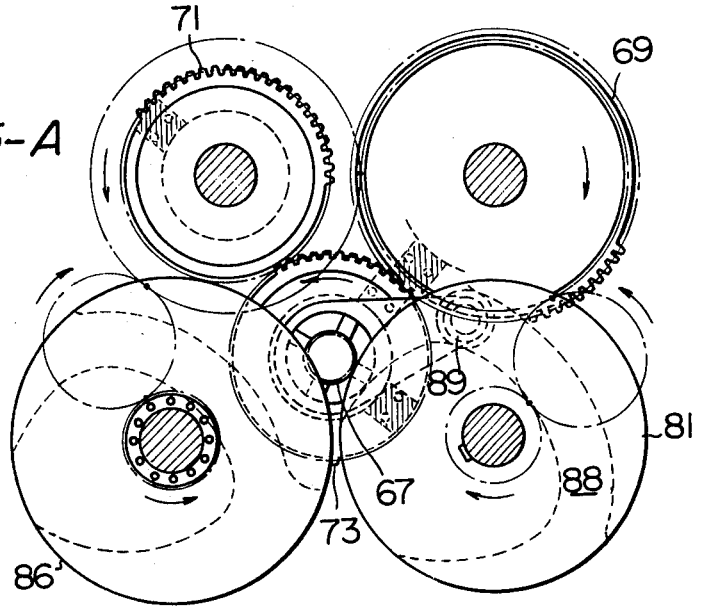
Fig. 5-B
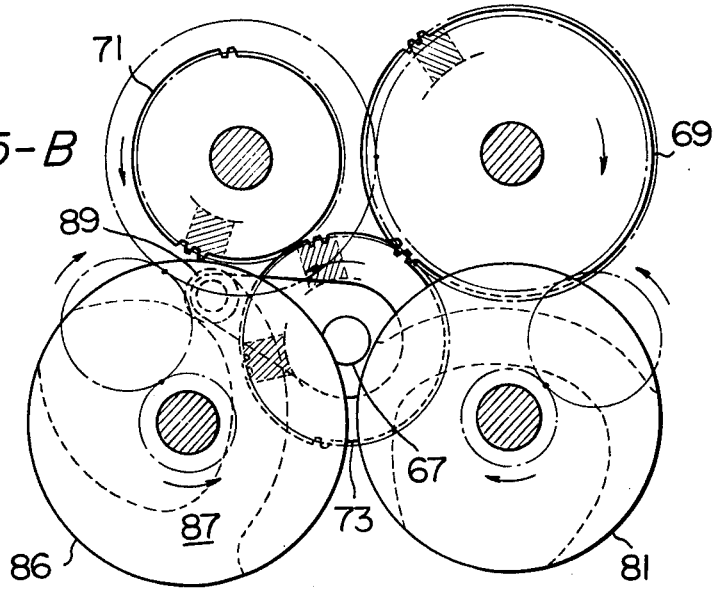

Fig. 5-C
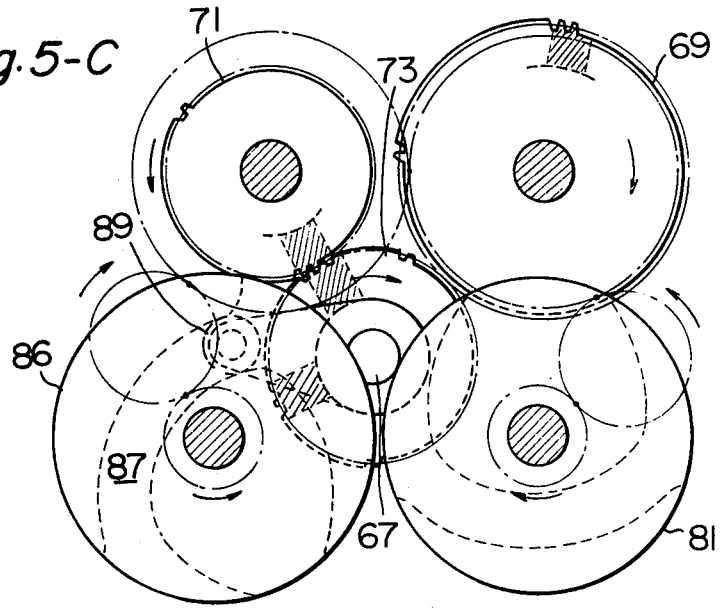
Fig. 5-D
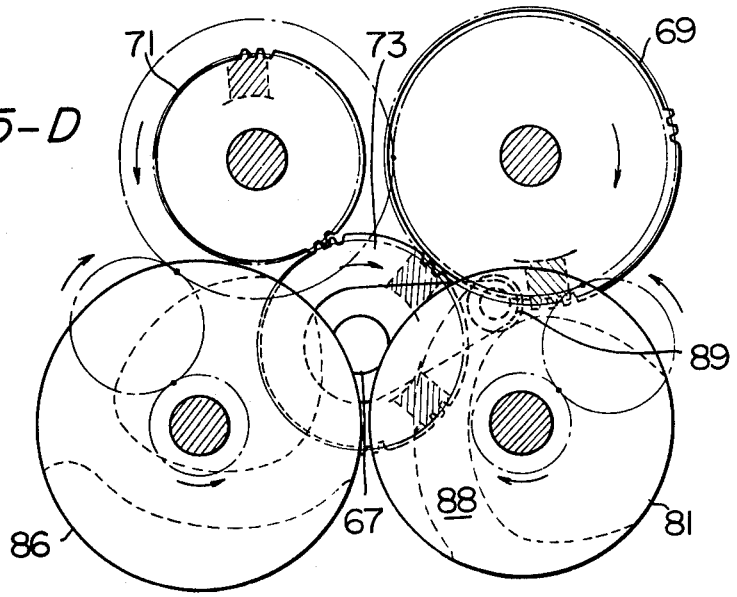

Fig. 5-E
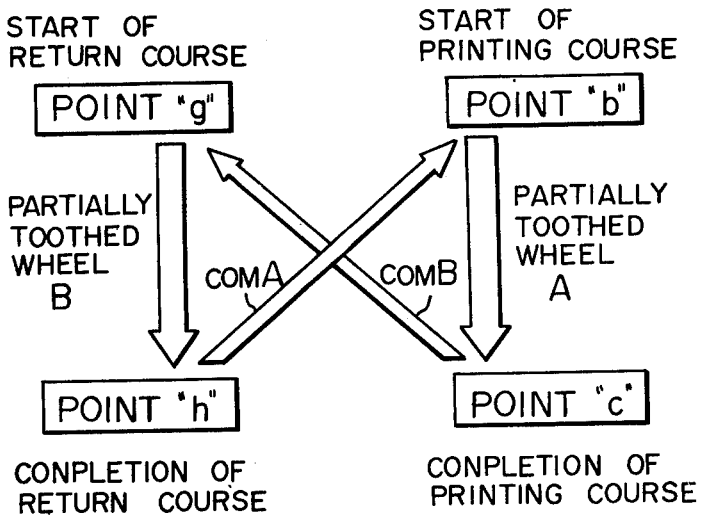

Fig. 7-A
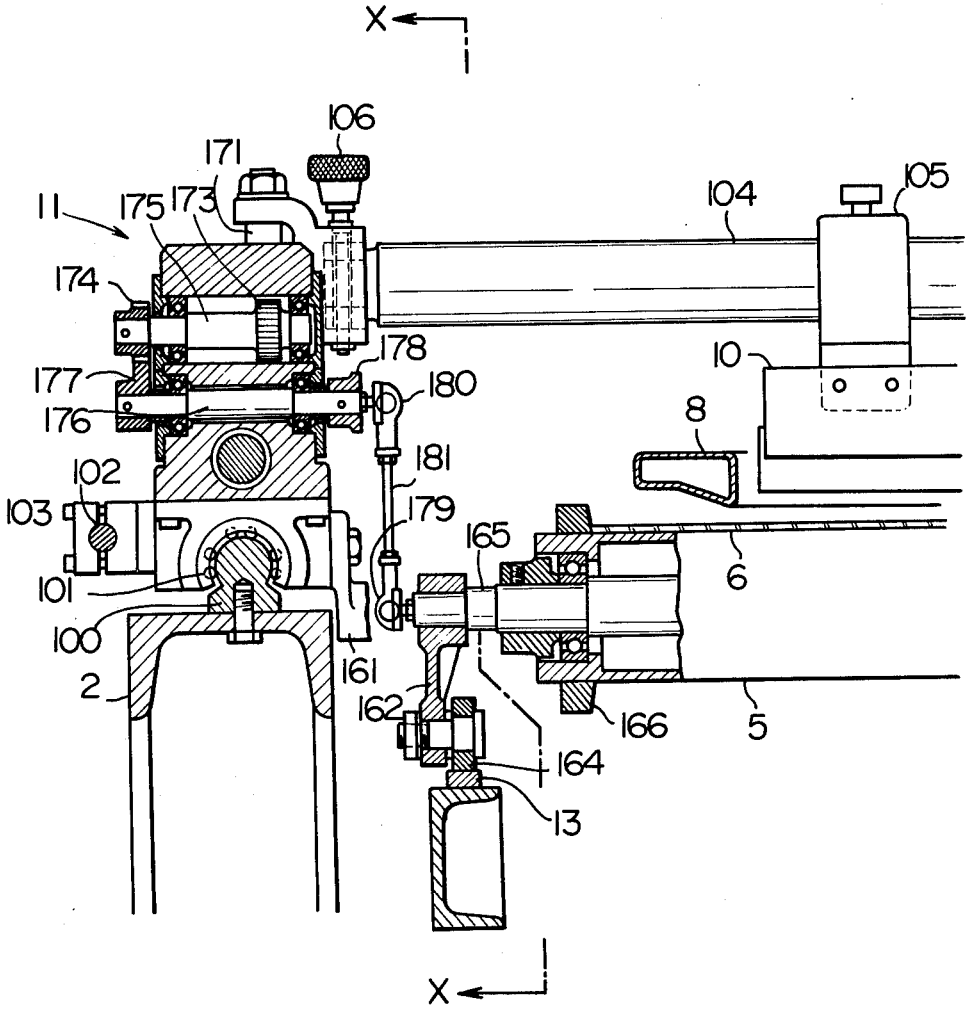

Fig. 7-B
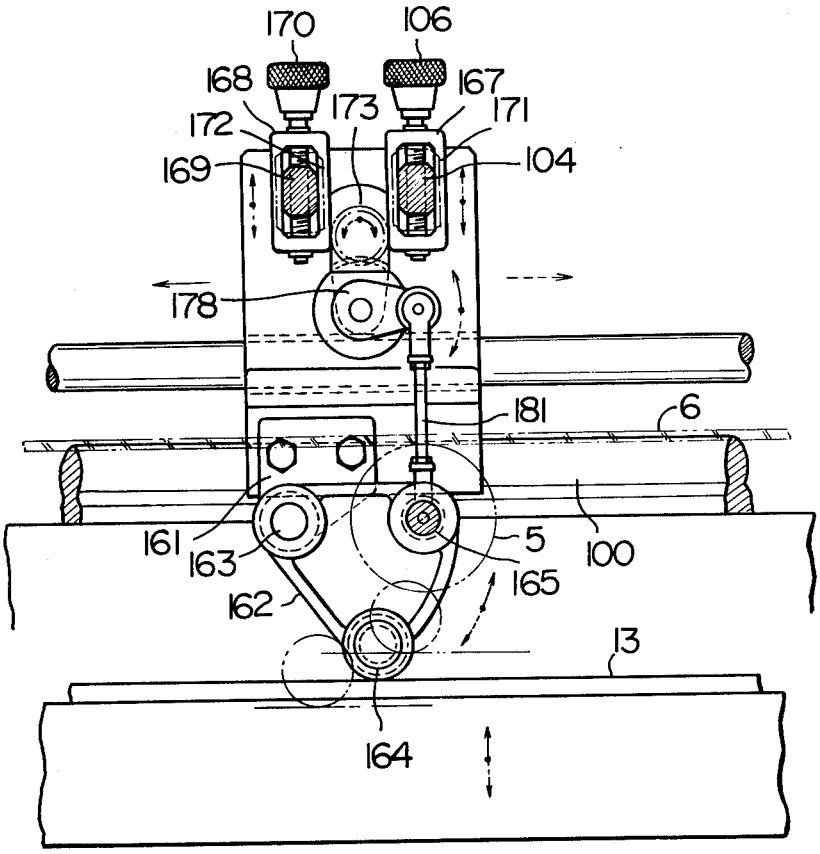

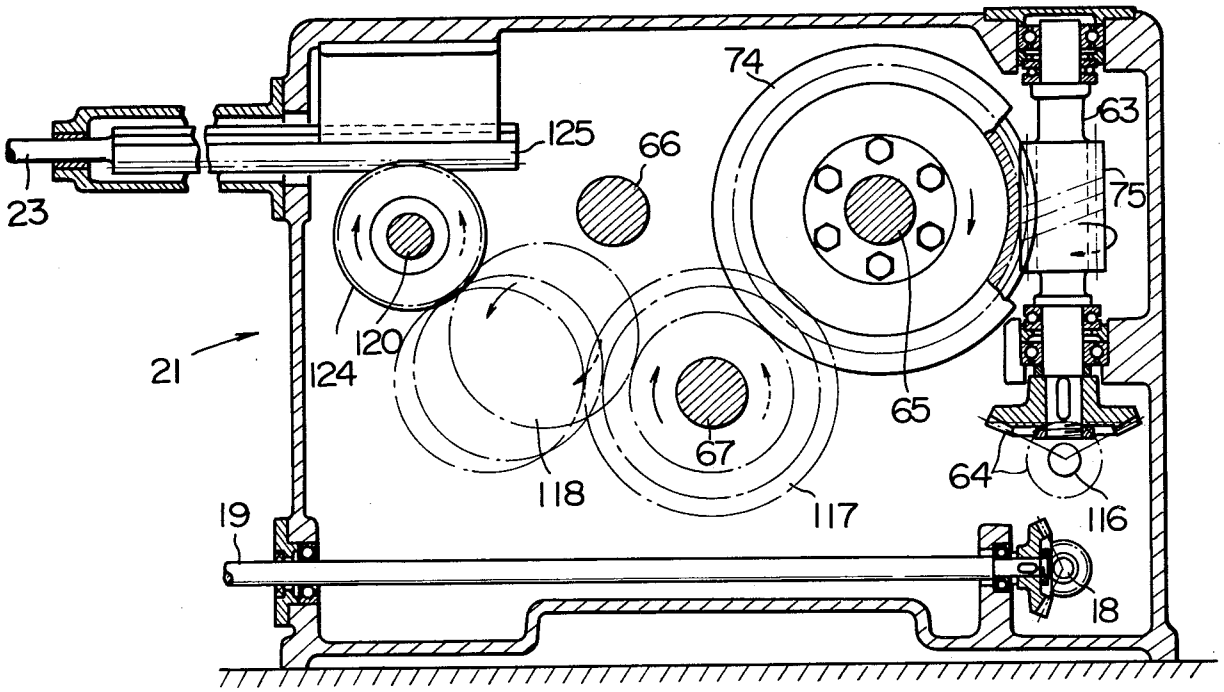
Fig. 10-A

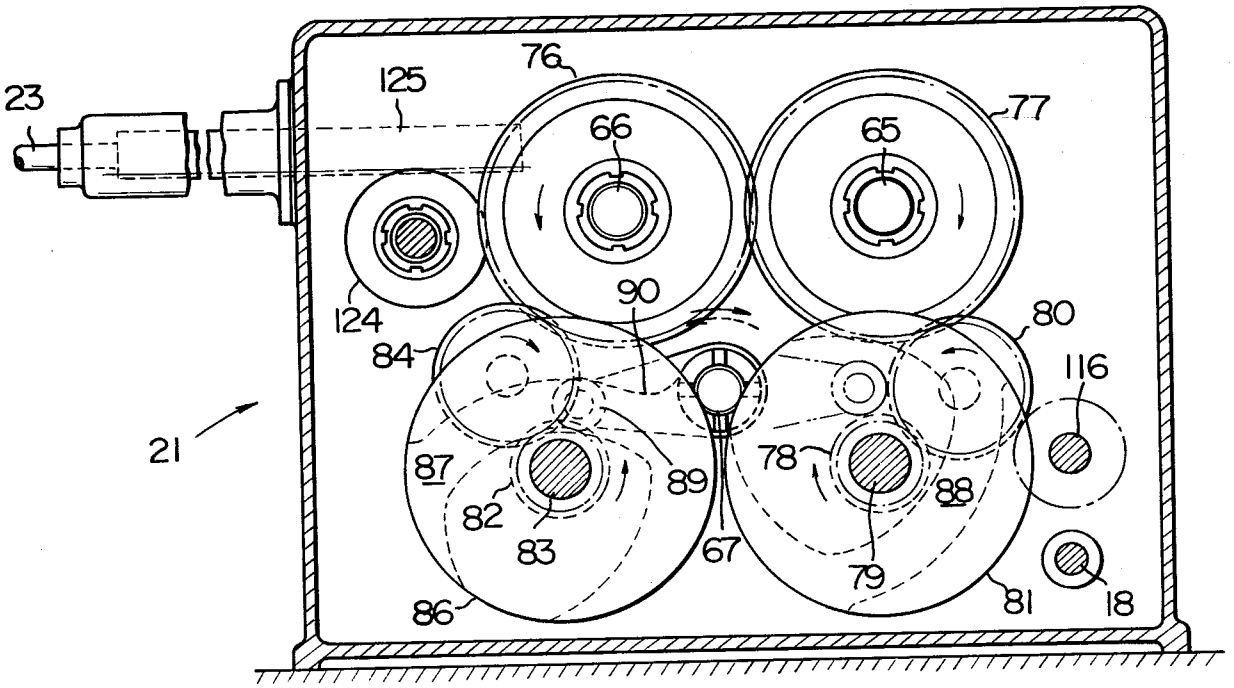
Fig. 10-B

Fig. 10-C
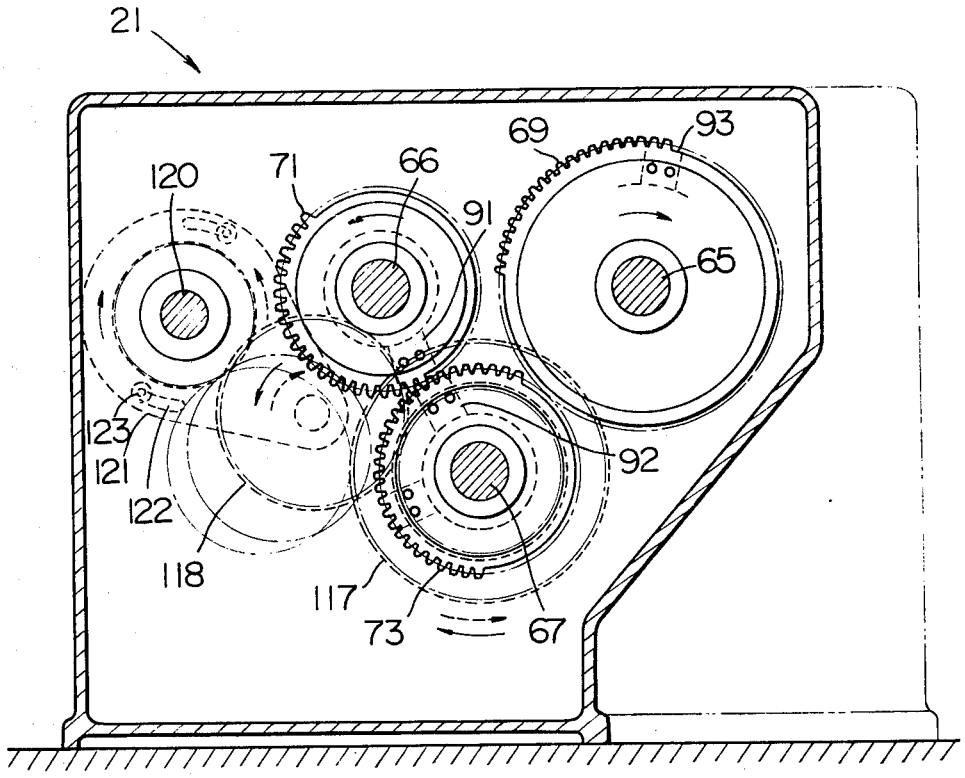

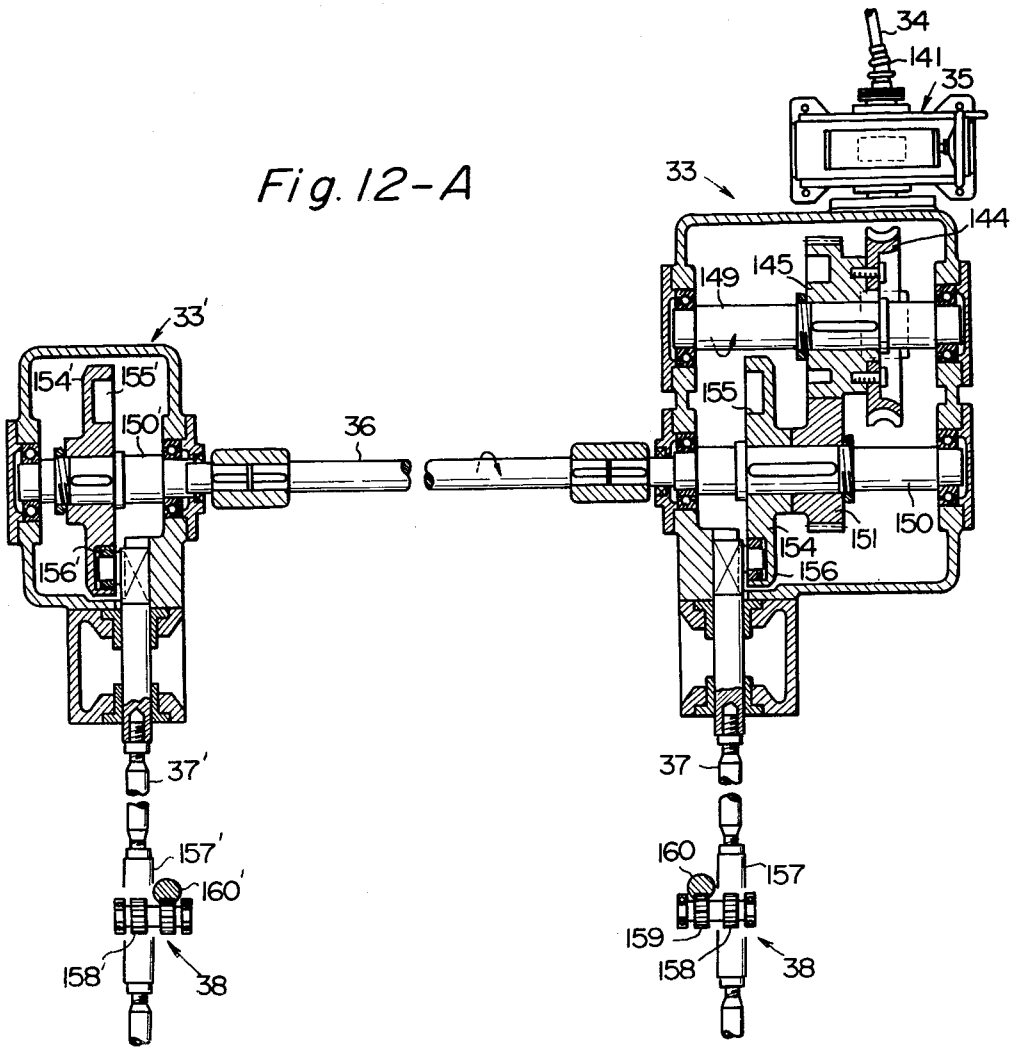
Fig. 12-A

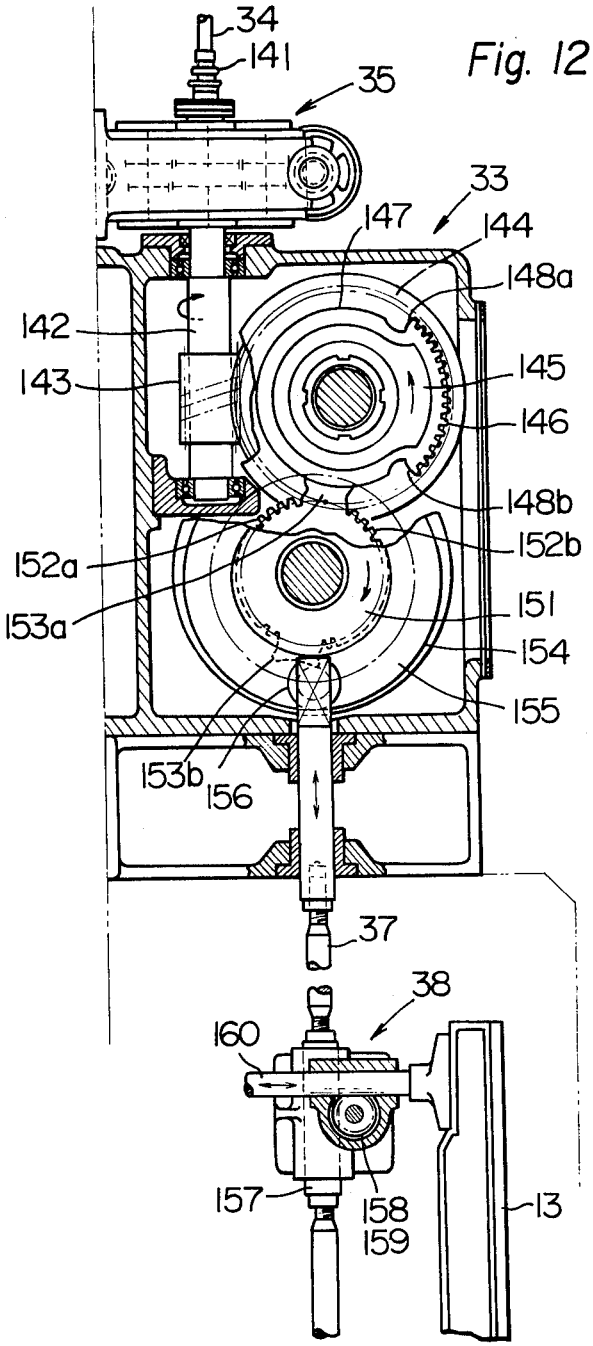
Fig. 12-B

AUTOMATIC SCREEN PRINTING METHOD AND APPARATUS

This invention relates to an automatic screen printing method and an apparatus for practising this printing method. More particularly, the invention relates to an automatic screen printing method in which a material to be printed, such as paper and cloth, is continuously fed at a constant speed and the material is printed through a flat screen and an apparatus for practising this method.

In the instant specification, the word "printing" is used to mean not only ordinary printing of papers, films and the like but also dye printing of fabrics, cloths and the like.

In conventional automatic printing machines, an endless belt for supporting and transporting a material to be printed, such as cloth, is fed intermittently and while the endless belt is stopped, a screen is brought down on the material to be printed, and then, a squeegee member is scanned on the screen to squeeze out a printing paste on the material to be printed and the screen and squeegee member are lifted up and the endless belt is fed again.

In this conventional printing method, problems are involved in intermittent feeding of a material to be printed. For example, in order to register the material to be printed exactly with the screen, it is necessary to use an expensive printing belt (blanket) which has a much reduced tendency to elongate and a belt-stopping mechanism having a very high accuracy, and therefore, the structure of the printing machine is inevitably complicated and its price is very high. Further, when a flexible material is printed, an accurate pattern can hardly be printed because of a tension given when it is transported.

Recently, as a printing method overcoming the foregoing disadvantages, there has been proposed an automatic screen printing method which includes the steps of feeding continuously a material to be printed at a constant speed in the longitudinal direction by means of a transporting member, bringing down a printing stencil (screen), which has been positioned above the material to be printed, on the material to be printed to contact the stencil with the material to be printed, moving both the printing stencil and the material to be printed at the same speed in the same direction, squeezing out a printing paste on the material to be printed while the printing stencil travels along a length corresponding to about ½ of the pattern length, lifting up the printing stencil to release its contact with the material to be printed, moving the printing stencil in the reverse direction, and repeating the foregoing operations (see the specification of U.S. Pat. No. 3,168,036).

This automatic printing method is characterized in that a printing operation can be performed while a material to be printed is fed continuously at a constant speed, but the actual working of this printing involves various difficulties. For example, according to this automatic screen printing method, the operation of moving the printing stencil at the same speed in the same direction as the material to be printed and the operation of moving the printing stencil in the reverse direction after the printing step should be conducted so that the positions of the stencil and the material are made exactly in accord with each other for every repeat of a pattern to be printed, and timings of these operations should be exactly controlled so as to obtain a good matching between the stencil and the material for every repeat of the pattern. More specifically, in the automatic screen printing method of this type, since a material to be printed is continuously fed at a constant speed, control of positions of respective moving members and control of timings of respective operations are much more difficult than in the conventional printing method in which a material to be printed is stopped at the time of printing.

Further, in the printing machine of this type, when a screen frame, a squeegee member or an assembly of a squeegee member and a receiving roller is moved for scanning, it is generally difficult to prevent generation of shocks at a point of starting, stopping or turning in the reverse direction such member. When such shocks are absorbed by using a suitable mechanism, exact control of the above-mentioned timings is made further difficult by provision of such shock-absorbing mechanism.

Various limit switches or photoelectric switches are generally used in combination with electromagnetic clutches or the like for controlling positions of members making a reciprocative movement and timings of their movements. According to such electric control system, however, because of deviations or delays of the operation time of such switch or electromagnetic mechanism it is generally impossible to control timings of movements of respective members precisely.

It is therefore a primary object of this invention to provide an automatic screen printing method in which a material to be printed is continuously fed in a printing operation zone and while a flat screen and a squeegee member optionally with a receiving roller are being reciprocated, a pattern is printed repeatedly on the material to be printed in the state where the screen is exactly registered with the material to be printed.

Another object of this invention is to provide an automatic screen printing method in which scanning reciprocative movements, namely accelerated advance, constant speed advance, reduced speed advance, stopping, accelerated retreat, constant speed retreat, reduced speed retreat and stopping, of a printing flat screen and a squeegee member optionally with a receiving roller can be performed at good timings according to a strictly and mechanically controlled program.

Still another object of the present invention is to provide an automatic screen printing method in which scanning reciprocative movements of a printing flat screen and a squeegee member optionally with a receiving roller can be performed synchronously with the feeding movement of a mechanism for supporting and transporting a material to be printed in the state where the screen is exactly registered mechanically with the material to be printed.

A further object of the present invention is to provide an automatic screen printing method in which adjustment of the timing of the printing operation can be performed precisely with ease and once this timing is adjusted, further adjustment is unnecessary even if printing conditions are changed.

In accordance with the present invention, there is provided an automatic screen printing method comprising feeding a material to be printed into a printing operation zone, transporting in the supported state the material to be printed continuously at a constant speed in the lengthwise direction, moving a flat screen having a certain length in the longitudinal direction thereof along the material to be printed at the same speed in the same direction as the material to be printed to cause the material to be printed, which is being transported on a supporting and transporting member, to fall in contact with the flat screen, scanning a squeegee member disposed above the flat screen from one end of the flat screen to the other end to thereby print on the material, releasing the contact between the flat screen and the supporting and transporting member just before the squeegee member arrives at the other end of the flat screen, moving the squeegee member and the flat screen in a direction reverse to the moving direction for the printing operation to return the squeegee member and the flat screen to the original printing-starting positions, and repeating the foregoing operations, wherein supporting and transporting member, flat screen and squeegee member are driven by one common drive source and the operations of the supporting and transporting member, flat screen and squeegee member are performed according to a mechanically controlled program.

This invention will now be described in detail by reference to the accompanying drawings, in which:

FIG. 1-A is a side view showing the arrangement of an automatic screen printing apparatus to be used for working the method of the present invention;

FIG. 1-B is a plan view showing the apparatus of FIG. 1-A;

FIG. 2-A is an enlarged, partially sectional side view showing an endless belt driving device;

FIG. 2-B is an expansion plan showing the section taken along line X—X in FIG. 2-A;

FIG. 3 is a developed sectional view of a squeegee driving device;

FIG. 4-A is a view showing the section taken along the line $X_1$—$X_1$ in FIG. 3;

FIG. 4-B is a view showing the section taken along the line $Y_1$—$Y_1$ in FIG. 3;

FIG. 4-C is a view showing the section taken along the line $Z_1$—$Z_1$ in FIG. 3;

FIGS. 5-A to 5-D are diagrams illustrating operations of a partially toothed wheel and a cam in a squeegee driving device and a screen driving device, FIG. 5-A showing the operations at the start of the constant speed return course, FIG. 5-B showing the operations at the completion of the constant speed return course, FIG. 5-C showing the operations at the start of the printing course, and FIG. 5-D showing the operations at the completion of the printing course;

FIG. 5-E is a diagram illustrating the sequences of operations of a partially toothed wheel and a cam at respective courses;

FIG. 6 is a diagram illustrating displacments of a squeegee and a screen when they are driven to make reciprocative movements and of a lifting rail when it is lifted up and brought down;

FIG. 7-A is a sectional view of a squeegee supporting device and a receiving roller seen in a direction rectangular to the direction of advance;

FIG. 7-B is a view showing the section taken along the line X—X in FIG. 7-A;

Figure 9:
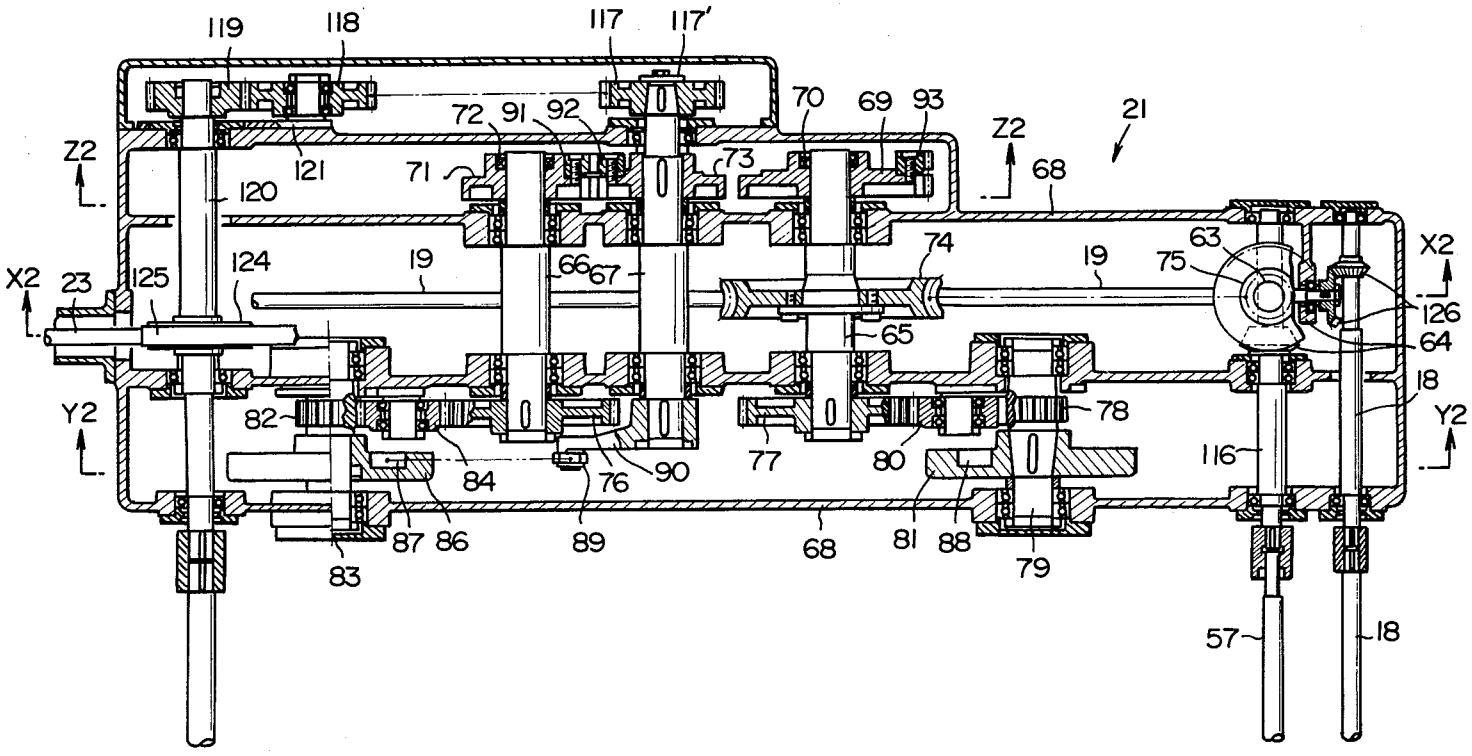
FIG. 9 is a developed sectional view of a screen driving device.
Figure 11:
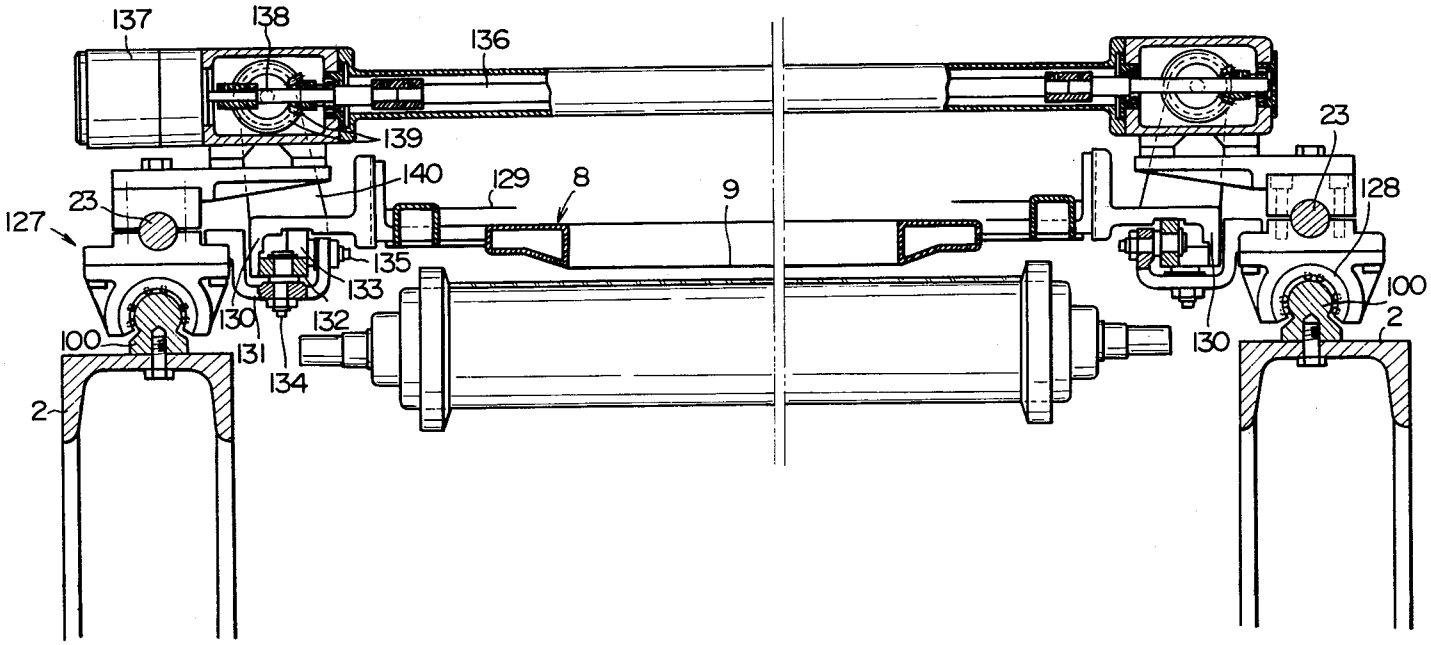

FIG. 10-A is a view showing the section taken along the line $X_2$—$X_2$ in FIG. 9;

FIG. 10-B is a view showing the section taken along the line $Y_2$—$Y_2$ in FIG. 9;

FIG. 10-C is a view showing the section taken along the line $Z_3$—$Z_3$ in FIG. 9;

FIG. 11 is a sectional view of a screen supporting and adjusting device seen in a direction rectangular to the direction of advance;

FIG. 12-A is a sectional plan view of a lifting device; and

FIG. 12-B is a sectional side view of the device shown in FIG. 12-A.

Referring to FIGS. 1-A and 1-B showing an embodiment of the apparatus suitable for practising the printing method of this invention, a mechanism for supporting and transporting a material 1 to be printed comprises a driving roller 3 and a driven roller 4 disposed on a machine frame 2 on both sides of a plurality of printing zones A, receiving rollers 5 disposed for respective printing zones, and an endless belt 6 supported and continuously driven by driving, driven and receiving rollers 4, 5 and 6. A paste is applied to this endless belt 6 by a suitable pasting mechanism (not shown), and the continuous material 1 to be printed is applied to the supporting surface of the endless belt 6 by a pasting roller 7 and fed to the printing zones A continuously at a constant speed. The printed material 1' is peeled from the endless belt 6 and fed to a winding reel or post treatment step (not shown).

The printing method of the present invention can be applied to printing of ordinary fabrics and cloths and screen printing of papers, films, metal foils and metal sheets. When a highly flexible material such as a fabric or cloth is printed, a supporting and transporting member such as an endless belt is used and the printing operation is conducted while the material to be printed is applied or pasted to this supporting and transporting member, or a continuous paper sheet is used as the supporting and transporting member instead of the endless belt, the fabric or cloth is pasted to the continuous paper sheet and the printing operation is conducted while the assembly of the paper sheet and the fabric or cloth is being continuously fed. When a material having a relatively flow flexibility, such as a paper, a film, a metal foil, a laminate thereof or a metal sheet, is printed, if a suitable tension adjusting mechanism is disposed on the side of a feed reel or winding reel of the material, provision of a supporting and transporting member such as an endless belt can be omitted.

In the printing zones A, flat screens 9 are supported on screen frames 8 above the running passage for the material 1 to be printed, namely above the upper portion of the endless belt 6, and the number of the screens 9 corresponds to the number of colors of a pattern to be printed. The screen frame 8 is supported on the machine frame 2 so that it can make a reciprocative movement in the horizontal direction along the endless belt 6 and during the printing operation, the screen frame 8 is driven at the same speed in the same direction as the material 1 to be printed by a screen driving mechanism detailed hereinafter and after the printing operation, the screen frame 8 is driven in a direction reverse to the direction of the movement of the material 1.

Above the flat screen 9 there is disposed a squeegee member 10 supported on a squeegee supporting mechanism 11 to squeeze out a printing paste or ink (not shown) onto the material 1 to be printed. This squeegee supporting mechanism 11 is supported on the machine frame 2 so that it can make a reciprocative movement in the horizontal direction along the endless belt 6. During the printing operation, the squeegee supporting mechanism 11 causes the squeegee member 10 to make a scanning movement from one end of the flat screen 9 to the other end of the flat screen 9, whereby printing of the material 1 can be accomplished. A doctor blade 12 is mounted on the squeegee supporting mechanism 11 to return the printing paste or ink to the printing-starting end of the screen after the printing operation.

In order to contact the material 1 on the endless belt 6 with the flat screen 9 at the printing operation and release this contact during the period where the printing operation is not conducted (hereinafter referred to as "the non-printing period"), the flat screen 9 and a part of the supporting and transporting mechanism, for example, the receiving roller 5, are arranged so that they can make relative vertical movements. In the embodiment shown in FIGS. 1-A and 1-B, a pair of the squeegee member 10 and the corresponding receiving roller 5 with the endless belt 6 interposed therebetween are arranged so that they can make a reciprocative movement in the horizontal direction, and during the printing operation, the receiving roller 5 is located at an elevated position to contact the material 1 with the printing screen and during the non-printing period, the receiving roller 5 is located at a lowered position to release the contact between the material 1 and the printing screen. A lifting rail 13 is disposed to guide the receiving roller 5 in the horizontal direction and lift up or bring down the receiving roller 5 in the vertical direction. The position of the lifting rail 13 is set and controlled by a lifting device detailed hereinafter, and the receiving roller 5 is moved vertically with the vertical movement of this lifting rail 13.

By reciprocating the flat screen 9 on one horizontal plane, scanning a pair of the squeegee member 10 and receiving roller 5 on the flat screen 9 and moving up and down the receiving roller 5 in the vertical direction as illustrated in FIGS. 1-A and 1-B, the material 1 to be printed can be registered exactly with the flat screen 9, and a deviation of a pattern at every repeat can be remarkably reduced. In the conventional printing method using a flat screen, when the screen contacted with the material to be printed throughout the surface thereof is separated from the material at the completion of the printing operation, there is caused an undesirable phenomenon of scattering of a printing paste or ink from the printing screen. In the embodiment of the present invention shown in FIGS. 1-A and 1-B, the part of the screen to be contacted with the material 1 is restricted to the region gripped between the squeegee member and the receiving roller, and even when the screen is separated from the material 1 at a high speed at the completion of the printing operation, scattering of the printing paste or ink can be effectively prevented. In the present invention, instead of the vertically movable receiving roller 5, a fixed receiving roller may be used and fixed to the machine frame 2. In this case, the flat screen 9 is mounted on a vertical movable frame member so that the screen can make a reciprocative movement in the horizontal direction.

The printing operation using the apparatus shown in FIGS. 1 and 2 will now be described.

The material 1 to be printed is pasted on the surface of the endless belt 6 by the pasting roller 7, and the material 1 is supported and fed continuously at a constant speed in a certain direction (to the left in the drawings) into the printing zones A by the endless belt 6. At the start of the printing operation, the flat screen 9 is moved in the same direction (to the left) as the moving direction of the material 1 at the same speed as the moving speed of the material 1. At this moment, the squeegee member 10 is located at one end of the screen 9 (the left end in the drawings). The receiving roller is lifted up to the uppermost position just after the completion of acceleration of the screen 9 to cause the material 1 on the endless belt 6 to fall in contact with the screen 9. In this state, the squeegee member 10 is paired with the receiving roller 5 and they are moved in a direction (to the right in the drawings) reverse to the moving direction of the material 1 to perform printing on the moving material 1 through the screen 9.

Just before the squeegee member 10 arrives at the other end (the right end in the drawings) of the screen 9, the printing operation is completed, and the lifting rail 13 is lowered and in turn, the receiving roller 5 is lowered, whereby the contact of the material 1 with the flat screen 9 is released. The advance of the flat screen 9 is stopped and the screen 9 is then moved in a direction (to the right in the drawings) reverse to the moving direction of the material 1. The squeegee member is held by the squeegee supporting mechanism 11 and is exchanged by the doctor blade 12 and the squeegee supporting mechanism 11 is moved in the same direction as the moving direction of the material 1, whereby the ink or paste of the screen 9 is returned to the printing-starting end. With this movement of the squeegee supporting mechanism 11, the receiving roller 5 is moved in the same direction as the moving direction of the material 1 at the lowered position thereof.

When the squeegee supporting mechanism 11 arrives at one end (the left end in the drawings) of the screen, the return course movements of the flat screen 9 and the pair of the squeegee member and the receiving roller are stopped. In this state, the doctor blade 12 is exchanged by the squeegee member 10 and the receiving roller 5 is lifted up, and the printing course movement of the screen 9 and squeegee member 10 is started. Thus, the foregoing operations are continuously repeated. In this automatic screen printing method of the present invention, during a period from the start of the printing operation to the start of the printing operation of the next cycle, the material 1 to be printed is moved by a distance corresponding to the length of one repeat, and the material 1 can be printed in a continuous manner.

One of the important features of the present invention resides in that the above-mentioned supporting and transporting means 3, 5 and 6, flat screen 9 and squeegee member 10 are driven by one common drive source and the operations of these members 3, 5, 6, 9 and 10 are performed according to a mechanically controlled program. More specifically, according to the present invention, the above-mentioned scanning reciprocative movements of the printing flat screen 9 and squeegee member 10 are always made synchronous with the feed speed of the supporting and transporting mechanism 6, whereby the printing operation can be performed at a high speed with a high printing accuracy in a continuous manner. When the above-mentioned scanning reciprocative movements of the printing flat screen 9 and squeegee member 10 are appropriately combined with such operations as acceleration, reduction and stopping and all the movements and operations are performed smoothly, no deviation is caused in timings for respective operations and movements and these timings can be set and adjusted with high accuracy very easily.

As the common drive source for driving the endless belt 6, the flat screen 9 and the squeegee supporting mechanism 11 and moving vertically the receiving roller 5, there is disposed a driving motor 14 on one end portion of the machine frame 2.

An endless belt driving device 15 for driving continuously an endless belt driving roller 3 at a constant speed is disposed, and the driving power of the driving motor 14 is transmitted to a main shaft 17 through a V-belt 16 and then transmitted to the endless belt driving device 15 through a belt-driving connecting shaft 18 and a belt-driving input shaft 19. The main shaft 17 is connected to the driving motor 14 through an electromagnetic clutch 20.

A screen driving device 21 is disposed to reciprocate the screen frame 8 in the horizontal direction. In this screen driving device 21, by a combined operation of a partially toothed wheel and a cam, detailed hereinafter, the continuous one-way rotation of the main shaft 17 is converted to alternating normal and reverse rotations of a screen driving shaft 22 and then converted to the horizontal reciprocative movement of a screen-driving connecting rod 23 extending in the moving direction of the screen 9, namely along the endless belt, by a combination of a pinion and a rack. This screen-driving connecting rod 23 includes a plurality of screen frames 8 fixed thereto at prescribed intervals, and these screen frames 8 are reciprocated in the horizontal direction with the reciprocative movement of the connecting rod 23.

A squeegee driving device 24 is disposed to reciprocate the squeegee supporting mechanism 11 in the horizontal direction. Also in this squeegee driving device 24, the continuous one-way rotation of the main shaft 17 is converted to alternating normal and reverse rotations of a squeegee driving output shaft 25 by a combined operation of a partially toothed wheel and a cam, detailed hereinafter, and the alternating normal and reverse rotations of the shaft 25 are transmitted to a squeegee driving sprocket 29 through a series of power transmitting means such as a squeegee accelerating mechanism 26, a squeegee driving shaft 27 and a miter gear case 28. Idle wheels 30 and 31 are disposed on both the terminal portions of the reciprocative movement passage for the squeegee supporting mechanism 11, and a roller chain 32 is stretched among these idle wheels 30 and 31 and the squeegee driving sprocket 29 and a plurality of squeegee supporting mechanisms 11 are fixed to the roller chain 32 at suitable intervals through a suitable fixing mechanism (detailed hereinafter). In this arrangement, by the alternating normal and reverse rotations of the squeegee driving sprocket 29, each of the squeegee supporting mechanisms 11 is reciprocated at the horizontal direction.

Below each printing zone, a lifting device 33 is disposed to move up and down in the vertical direction the receiving roller supporting the endless belt 6. The continuous one-way rotation of the main shaft 17 is transmitted to this lifting device 33 through an output shaft 34 and a timing adjusting device 35. In this lifting device 33, the rotation of the main shaft 17 is converted to stopping of rotation of a lifting connecting shaft 36 for a prescribed period and intermittent reciprocative movement of a lifting connecting rod 37 by a combined operation of a partially toothed wheel and a cam, detailed hereinafter. These operations of the connecting shaft 36 and connecting rod 37 are transmitted to the lifting rail 13 by a pinion-rack mechanism 38, whereby rising of the lifting rail 31 and the receiving roller 5, stopping of the lifting rail 13 and receiving roller 5 at the elevated position, lowering of the lifting rail 13 and receiving roller 5 and stopping of the lifting rail 13 and receiving roller 5 at the lowered position are performed.

Referring now to FIGS. 2-A and 2-B illustrating the endless belt driving device 15, the belt-driving input shaft 19 is engaged with the shaft 39 through a bevel gear 40. A repeat-adjusting change gear 41 having parts differing in the number of teeth and hence differing in the diameter is exchangeably mounted on the shaft 39 through a suitable clamping mechanism 42. A second shaft 44 having a gear 43 on the same plane as of the change gear 41 is disposed at a point appropriately spaced from the first 39. A swinging piece 45 is mounted so that it can swing with the second shaft 44 being as the center, and an idle gear 46 is rotatably mounted on the end of this swinging piece 45. All of the repeat-adjusting change gear 41, the idle gear 46 and the gear 43 are located on the same plane. Arc-like long pin holes 47 are formed on the swinging piece 45, and the idle gear 46 can be fixed by clamping means such as stud bolts 48 at such a position that the idle gear 46 is engaged with both the change gear 41 and the gear 43. A belt driving gear 50 is fixed to a shaft 49 of the driving roller 3 and is connected with a gear 51 fixed to the second shaft 44 through a series of gears 52 and 53.

In the belt driving device 15 shown in FIGS. 2-A and 2-B, the driving power transmitted from the belt-driving input shaft 19 is transmitted to the driving roller 3 through a series of the above-mentioned gear means. Further, by attaching the repeat-adjusting change gear 41 having parts differing in the number of teeth to the shaft 39, the driving roller 3 and endless belt 6 can be rotated at variable speeds in response to adjustment of the repeat length, which will be detailed hereinafter.

Referring now to FIGS. 4-A, 4-B and 4-C illustrating the structure of the squeegee driving device 24, a gear 54 fixed to the main shaft 17 is engaged with a gear 56 fixed to a screen- and squeegee-driving shaft 55 and the driving power of the driving motor 14 is transmitted to the driving shaft 55 through the main shaft 17. A screen driving shaft 57 is connected to this driving shaft 55 to transmit the driving power to the screen driving device 21 detailed hereinafter. A lifting device driving gear 58 is mounted on this driving shaft 55 to drive the lifting device 33, and the driving power of the motor 14 is transmitted to a lifting driving shaft 61 through a series of gears 59 and 60 and to the lifting device 33 through a bevel gear 62 and a lifting output shaft 37. A squeegee driving shaft 63 is disposed to extend in a direction rectangular to the extending direction of the screen- and squeegee-driving shaft 55 and the shaft 63 is engaged with the shaft 55 through a pair of bevel gears 64. In the present invention, by adoption of this arrangement, all of the driving devices 15, 21, 24 and 33 are driven by one common driving motor 14.

In the automatic screen printing method of the present invention, the reciprocative movement of the flat screen 9 and squeegee member 10 is performed according to a mechanically controlled program. The preferred embodiment of this feature can be accomplished by performing alternately the operation of engaging a first partially toothed wheel connected to the screen-driving output shaft 22 or squeegee-driving output shaft 25 with a second partially toothed wheel driven in the normal direction and the operation of engaging the first partially toothed wheel with a third partially toothed wheel driven in the reverse direction, whereby the output shaft 22 or 25 can be rotated and driven alternately in the normal direction and in the reverse direction and a cam follower pivoted on the first partially toothed wheel can be engaged with a driven and rotated cam at the start of each of the above rotation operations and at the completion of each of the above rotation operations to thereby impart an accelerating power to the output shaft at the start of the rotation thereof and a speed-reducing power to the output shaft at the completion of the rotation thereof. This preferred arrangement will now be described.

Figure 3:
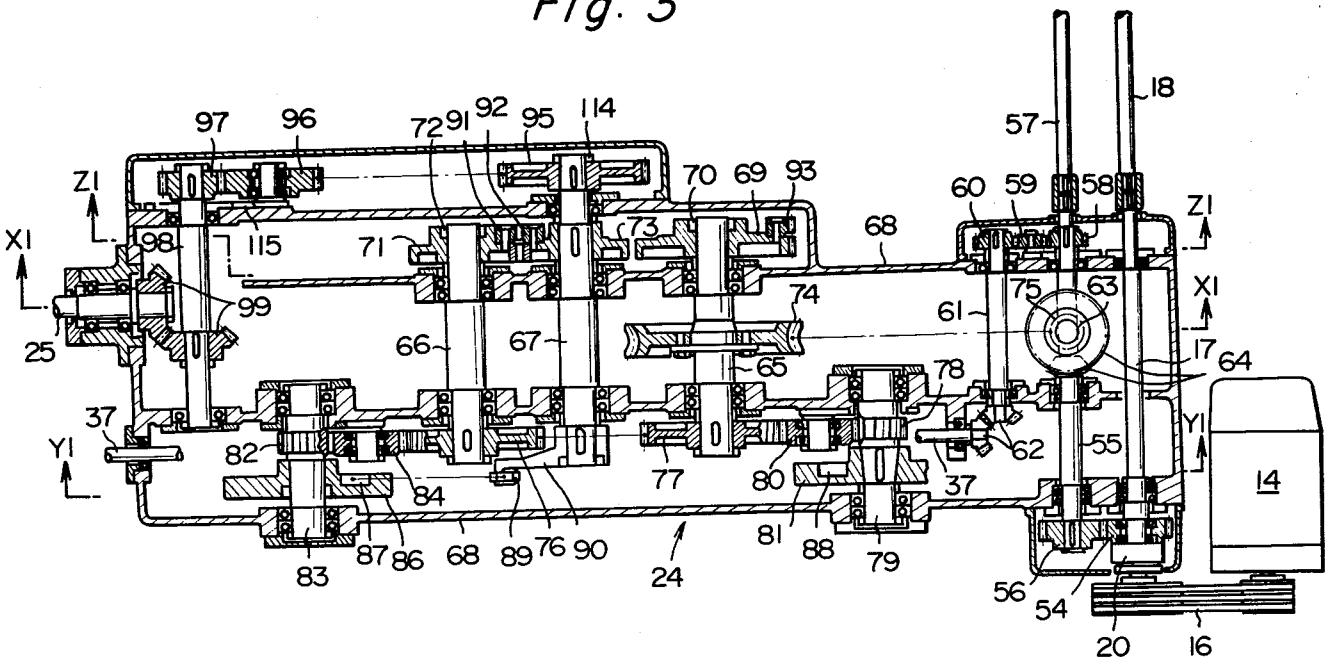

Referring now to FIGS. 3 and 4-A to 4-C, a reverse direction driving shaft 65, a normal direction driving shaft 66 and a shaft 67 for reciprocative rotation in normal and reverse directions are rotatably mounted on a frame 68 so that they are appropriately spaced from one another. The third partially toothed wheel indicated by reference numeral 69 is attached to the reverse direction driving shaft 65 so that it can be adjusted by a fine adjustment coupling 70, and the second partially toothed wheel indicated by reference numeral 71 is attached to the normal direction driving shaft 66 so that it can be adjusted by a fine adjustment coupling 72. The second partially toothed wheel indicated by reference numeral 73 is fixed to the shaft 67 for reciprocative rotation in normal and reverse directions so that the partially toothed wheel 73 is located on the same plane as of the partially toothed wheels 71 and 69.

A worm gear 74 is fixed to the reverse direction driving shaft 65, and when this worm gear 74 is engaged with a worm 75 fixed to the squeegee driving shaft 63, the reverse direction driving shaft 65 is rotated in the clockwise direction. A cam driving gear 76 is fixed to one end of the normal direction driving shaft 66, and when this gear 76 is engaged with another cam driving gear 77 fixed to one end of the reverse direction driving shaft 65, the normal direction driving shaft 66 is rotated in the counter-clockwise direction.

In order to perform speed reduction, stopping and acceleration of the screen 9 and squeegee member 10 according to the mechanically controlled program, a first cam is employed for controlling reduced speed advance, stopping and accelerated retreat and a second cam for controlling reduced speed retreat, stopping and accelerated advance, and the above control is performed by engaging the cam follower pivoted on the first partially toothed wheel alternately with the second cam and the first cam. This arrangement will now be described in detail.

Referring now to FIGS. 3 and 4-B, a first cam driving shaft 79 provided with a spur gear 78 is disposed in parallel to the reverse direction driving shaft 65, and when the spur gear 78 is engaged with the cam driving gear 77 through an idle gear 80, the cam driving shaft 79 is driven in the clockwise direction to rotate in the clockwise direction the first cam for controlling reduced speed advance, stopping and accelerated retreat of the squeegee member, which cam is indicated by reference numeral 81. Similarly, a second cam driving shaft 83 provided with a spur gear 82 is disposed on the frame 68 in parallel to the normal direction driving shaft 66, and when the spur gear 82 is engaged with the cam driving gear 76 of the normal direction driving shaft 66 through an idle gear 84, the cam driving shaft 83 is given in the counter-clockwise direction to rotate in the counter-clockwise direction the second cam for controlling reduced speed retreat, stopping and accelerated advance of the squeegee member, which cam is indicated by reference numeral 86. Cam grooves 87 and 88 are formed on the second cam (86) and the first cam (81), respectively. An arm 90 provided with a cam roller 89 is fixed to one end of the shaft 67 for reciprocative rotation in the normal direction and reverse direction. The cam roller 89 is located on the same plane as of the cam grooves 87 and 88, and when the arm 90 is turned and the cam roller 89 is engaged with the cam groove 87 or 88, the above-mentioned control of speed reduction, stopping and acceleration is conducted.

The cam driving shafts 79 and 83 are driven and rotated at speeds synchronized with the speeds of the reverse direction driving shaft 65 and the normal direction driving shaft 66, namely the rotation numbers of the cam driving shafts 79 and 83 are integral multiples of the rotation numbers of the reverse direction driving shaft 65 and normal direction driving shaft 66. In general, when the cam driving shafts 79 and 83 are rotated at rotation numbers at least two times the rotation numbers of the shafts 65 and 66, control of speed reduction, stopping and acceleration can be accomplished very precisely. In the embodiment shown in the drawings, the rotation number of the shaft 65 is equal to the rotation number of the shaft 66, and each of the rotation numbers of the shafts 79 and 83 is 3 times the rotation number of the shafts 65 and 66.

The positions and tooth numbers of the partially toothed wheels 69, 71 and 73 are set so that the first partially toothed wheel (73) is engaged with the second partially toothed wheel (71) only on the constant speed driving in the normal direction and the first partially toothed wheel (73) is engaged with the third partially toothed wheel (69) only on the constant speed driving in the reverse direction. At the position where engagement between the normal direction driven partially toothed wheel (71) and the partially toothed wheel (73) begins, planted teeth 91 and 92 are disposed for reinforcement, and another planted teeth 93 and 94 are similarly disposed for reinforcement at the position where engagement between the reverse direction driven partially toothed wheel (69) and the partially toothed wheel (73) begins.

Figure 6:
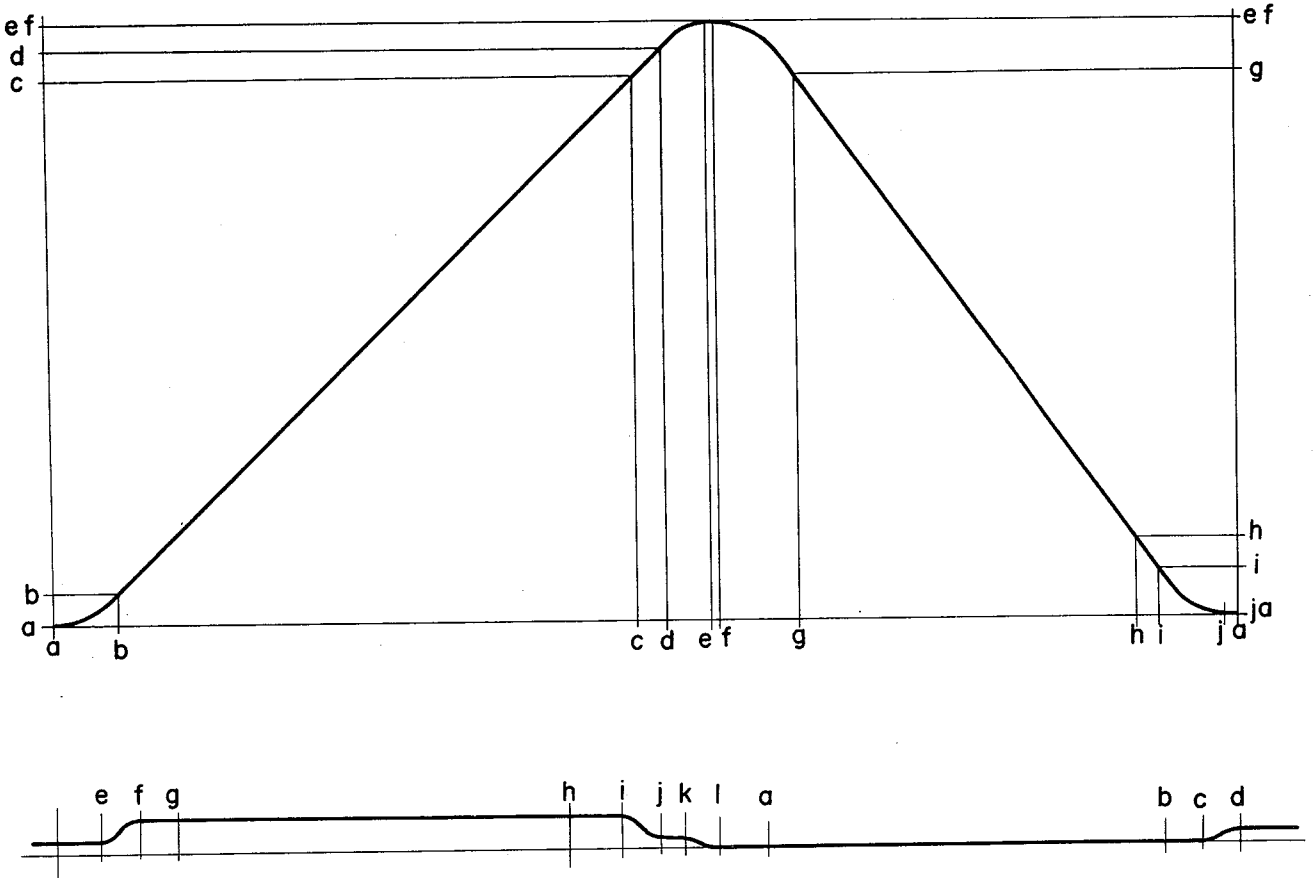

Operations of respective partially toothed wheels and cams of the above-mentioned squeegee driving device 24 will be apparent from FIGS. 5-A to 5-D illustrating the respective operations, FIG. 5-E illustrating the sequence of the operations and FIG. 6 illustrating displacements of the squeegee and screen.

In FIG. 5-A showing the state where each member is at the position of the start of the return course (the position of the start of the constant speed driving in the reverse direction; the position *g* in FIGS. 5-E and 6), the partially toothed wheel (73) is engaged with the partially toothed wheel (69) and the cam roller 89 is going to separate from the cam groove 88 of the cam (81). In this state, the partially toothed wheel (73) is driven in the counter-clockwise direction by the partially toothed wheel (69) and with this rotation of the partially toothed wheel (73), the shaft 67 for reciprocative rotation in the normal and reverse directions is driven and rotated at a constant speed in the counter-clockwise direction (in the reverse direction; in the return direction), whereby the shaft 67 is caused to make a displacement of line *g-h* in FIG. 6. With this displacement, the engagement of the cam roller 89 with the cam groove 89 is released and the cam roller 89 is rotated in the counter-clockwise direction.

In FIG. 5-B showing the state where each member is at the position of the completion of the return course (the position of the start of the reduced speed driving in the reverse direction; the position *h* in FIGS. 5-E and 6), the partially toothed wheel (73) is at the position where its engagement with the partially toothed wheel (69) is released, and the cam roller 89 is at the position where it begins to fall in engagement with the cam groove 87 of the cam (86). From this state, the partially toothed wheel is moved and it is not engaged with the partially toothed wheels (69) or (71), but the cam roller 89 is engaged with the cam groove 87 of the cam (86) and is driven in the counter-clockwise direction, whereby it is driven at the constant speed in the reverse direction to some extent; namely it is caused to make a displacement of line *h-i* in FIG. 6. Then, the cam roller 89 is engaged with the speed-reducing part of the cam groove 87, whereby it is rotated at a reduced speed in the reverse direction; namely it is caused to make a displacement of curve *i-j* in FIG. 6. Then, the cam roller 89 is engaged with the stopping part of the cam groove 87, whereby the cam roller 89 is stopped and in turn, the shaft 67 for reciprocative rotation in the normal and reverse directions is stopped (line *j-a* in FIG. 6). Subsequently, the cam roller 89 is engaged with the accelerating part of the cam groove 87, whereby the cam roller 89 is accelerated and driven in the normal direction and the rotation shaft 67 is driven in the clockwise direction (a displacement of curve *a-b* in FIG. 6 is made).

In FIG. 5-C showing the state where each member is at the position of the start of the printing course (the position of the start of the driving in the normal direction; namely the position *b* in FIGS. 5-E and 6), the partially toothed wheel (73) is engaged with the partially toothed wheel (71) and the cam roller 89 is at the position where it is going to separate from the cam groove 87 of the cam (86). In this state, the partially toothed wheel (73) is driven in the clockwise direction by the partially toothed wheel (71), and simultaneously, the shaft 67 for reciprocative rotation in the normal and reverse directions is driven and rotated at a constant speed in the clockwise direction (in the normal direction; in the direction of advance) and is caused to make a displacement of line *b-c* in FIG. 6. With this displacement of the shaft 67, the cam roller 89 is released from its engagement with the cam groove 87 and is rotated in the clockwise direction. In FIG. 5-D showing the state where each member is at the position of the completion of the printing course (the position of the start of the reduced speed driving in the normal direction; namely the position *c* in FIGS. 5-E and 6), the partially toothed wheel (73) is at the position where its engagement with the partially toothed wheel (71) is released, and the cam roller 89 begins to fall in engagement with the cam groove 88 of the cam (81). In this state, the partially toothed wheel (73) is moved and is not engaged with the partially toothed wheels (71) or (69), but the cam roller 89 is engaged with the constant speed driving part of the cam groove 88, whereby the cam roller 89 is rotated in the clockwise direction at a constant speed to some extent; namely a displacement of line *c-d* in FIG. 6 is made by the shaft 67 for reciprocative rotation in the normal and reverse directions. Then, the cam roller 89 is engaged with the speed-reducing part of the cam groove 88, whereby the cam roller 89 is rotated in the normal direction at a reduced speed to make a displacement of curve *d-e* in FIG. 6. Subsequently, the cam roller 89 is engaged with the stopping part of the cam groove 88, whereby the cam roller 89 is stopped and in turn, the shaft 67 for reciprocative rotation in the normal and reverse directions is stopped (line *e-f* in FIG. 6). Subsequently, the cam roller 89 is engaged with the accelerating part of the cam groove 88, whereby the cam roller 88 is accelerated and driven in the reverse direction and the shaft 67 for reciprocative rotation in the normal and reverse direction is driven in the counter-clockwise direction (a displacement of curve *f-g* in FIG. 6 is made).

Thus, each member in the squeegee driving device is returned to the position of the start of the return course (the position *g* in FIGS. 5-E and 6), and the above-mentioned operations are repeated. In the above illustrated embodiment of the present invention, since the driving of the shaft 67 for reciprocative rotation in the normal and reverse directions is performed in good order precisely by the partially toothed wheels 71 and 69 and cams 86 and 81 driven at synchronized speeds as most clearly illustrated in FIGS. 5-E and 6, each of the scanning reciprocative movements of the squeegee member, namely accelerated advance, constant speed advance, reduced speed advance, stopping, accelerated retreat, constant speed retreat and stopping, can be performed at a good timing without any deviation. Further, by skillfully combining the operation of driving at a constant speed the shaft 67 for reciprocative rotation in the normal and reverse directions by using gears with the operation of speed reduction, stopping and acceleration of the shaft 67 by using the cam mechanism, the respective operations of the reciprocative movement can be performed precisely according to the mechanically controlled program while preventing generation of mechanical shocks by the reciprocative movement.

In the method of the present invention, the speed for driving in the normal direction the shaft 67 for reciprocative rotation may be the same as or different from the speed for driving the shaft 67 in the reverse direction. These speeds can easily be adjusted by changing the diameters of the partially toothed wheels (71) and (69) to be engaged with the partially toothed wheel 23. For example, if the diameter of the reverse direction driven partially toothed wheel (69) is smaller than the diameter of the normal direction driven partially toothed wheel (71) as shown in the accompanying drawings, the speed for driving the shaft 67 in the reverse direction is made higher than the speed for driving the shaft 67 in the normal direction Degrees and patterns of speed reduction, stopping and acceleration by the cam (86) and cam (81) can be adjusted relatively freely by changing the shapes of the cam grooves 87 and 88 formed on the cams 86 and 81, respectively. In general, it is preferred to use cam grooves 87 and 88 having a shape of a modified trapezoid or modified sine curve at the accelerating part.

The driving mechanism for rotation in normal and reverse directions, which is illustrated in the accompanying drawings, is especially suitable for attaining objects of the present invention. In the present invention, other driving mechanism for rotation in normal and reverse directions, for example, a mechanism including cams alone or a mechanism including partially toothed wheels alone, may be used, so far as the foregoing operations are performed according to a mechanically controlled program.

Referring to FIGS. 3 and 4-A to 4-C again, in order to transmit rotations of the normal and reverse rotation shaft 67 in the normal and reverse directions to the squeegee-driving output shaft 25, a spur gear 95 is fixed to the other end of this normal and reverse rotation shaft 67, and by a gear 97 engaged with this spur gear 95 through an idle gear 96, the reciprocative rotation of the shaft 67 in the normal and reverse directions is transmitted to a driving shaft 98. This driving shaft 98 is engaged with the squeegee-driving output shaft 25 through a pair of bevel gears fixed to the shafts 98 and 25, respectively, so that the reciprocative rotation of the shaft 98 in the normal and reverse directions is transmitted to the shaft 25.

In the automatic screen printing method of the present invention, a guide rail is disposed along a running passage for the material to be printed, in general, along a running passage for the endless belt, and a plurality of squeegee member supporting mechanisms are mounted on the guide rail in common with the flat screen frame supporting members so that the supporting mechanisms can make a reciprocative movement. It is preferred that these squeegee member supporting mechanisms be fixed at prescribed intervals to a connecting rod extending along the guide rail and this connecting rod be reciprocated in the horizontal direction by the normal and reverse rotations of the squeegee-driving output shaft 25 detailed by reference to FIGS. 3 and 4-A to 4-C.

Referring now to FIGS. 7-A and 7-B illustrating the squeegee member supporting mechanism 11, a guide rail 100 extending in the widthwise direction of the machine is disposed above the machine frame 2, and the squeegee member supporting mechanism indicated as a whole by reference numeral 11 is mounted on the guide rail 100 through a slide bearing 101 so that the supporting mechanism 11 can make a reciprocative movement in the horizontal direction. A plurality of squeegee member supporting mechanisms 11 are fixed at prescribed intervals to a connecting rod 102 extending in parallel to the guide rail 100 by a suitable clamping mechanism 103 so that their positions can be finely and minutely adjusted. The squeegee member 10, for example, a squeegee doctor, is fixed to a squeegee holder 104 extending in a direction crossing the endless belt 6 by suitable clamping means 105. This squeegee holder 104 is attached to the squeegee member supporting mechanism 11 through pressure adjustment means such as a squeegee pressure adjustment screw 106.

Figure 8:
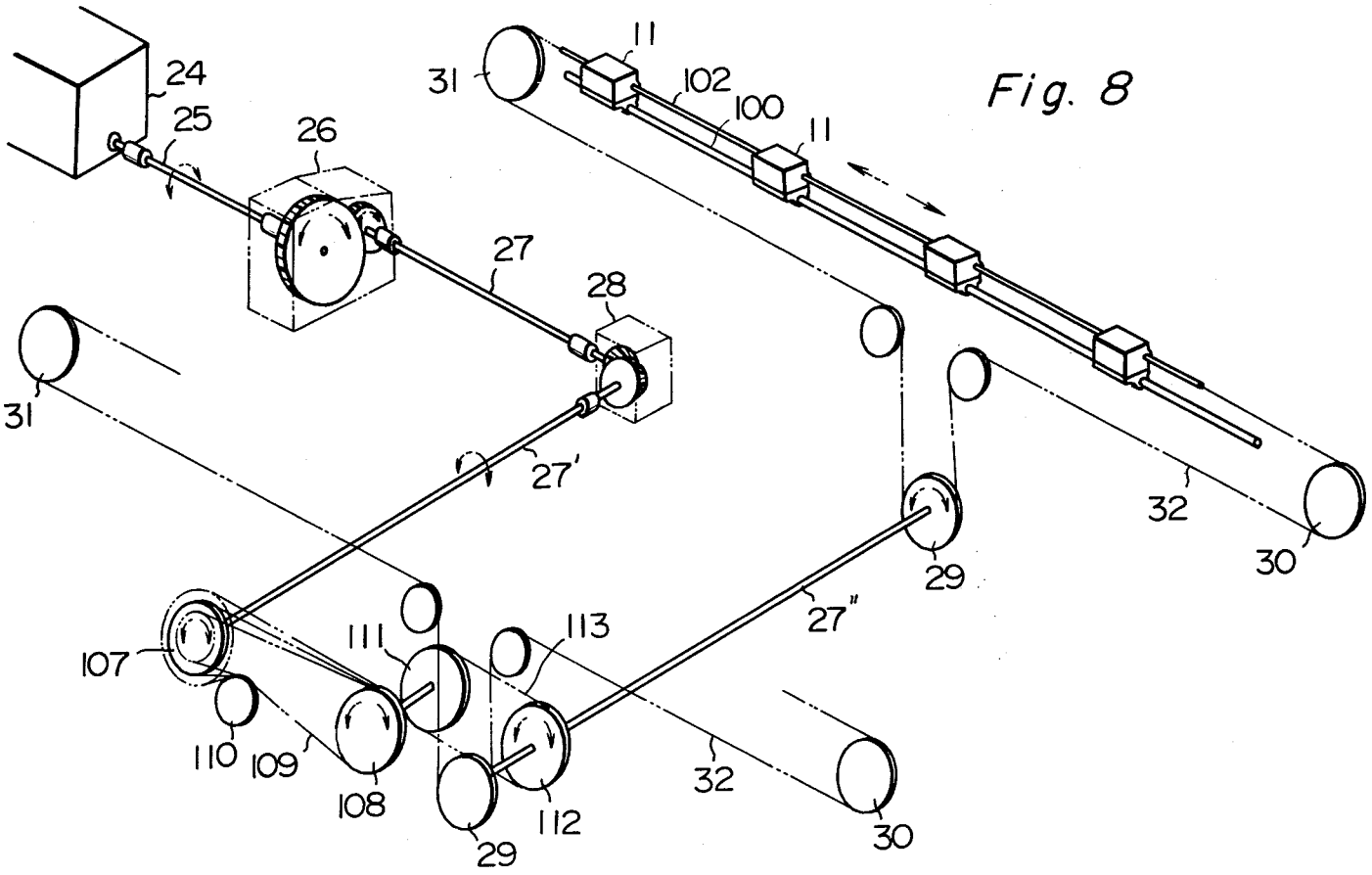
FIG. 8 is a perspective view of a squeegee driving system.

The horizontal reciprocative movement of the squeegee member is performed by, for example, a drive system shown in FIG. 8. The normal and reverse reciprocative rotation of the squeegee-driving output shaft 25 is transmitted to the squeegee driving shaft 27 through an accelerator 26 for the squeegee and also transmitted to a squeegee driving shaft 27' through a miter gear case 28 for the squeegee. A repeat-adjusting change wheel 107 is exchangeably mounted on the squeegee driving shaft 27'. A roller chain 109 is stretched between this change wheel 107 and a driven wheel 108 and an idle wheel 110 is disposed so that it can swing with the axis of the repeat-adjusting change wheel 107 being as the center and a certain tension is given to the roller chain 109 stretched between the wheel 107 and the wheel 108 irrespective of the diameter of the change wheel 107 used. The normal and reverse reciprocative rotation transmitted to the driven wheel 108 is transmitted to a squeegee driving shaft 27" through a power transmission mechanism such as a combination of a pair of wheels 111 and 112 with a chain 113, whereby the squeegee-driving sprocket 29 is reciprocatively rotated in the normal and reverse directions. The normal and reverse reciprocative rotation of the sprocket 29 is transmitted to a roller chain stretched among a pair of idle wheels 30 and 31 disposed on both the ends of the printing zones A and the driving sprocket 29, whereby each squeegee member supporting mechanism 11 is reciprocated in the horizontal direction exactly according to the mechanically controlled program.

In the embodiment of the squeegee driving device illustrated specifically in the accompanying drawings, the repeat-adjusting change wheel 107 is disposed at a position other than on the squeegee driving device 24. In the present invention, it is possible to use the spur gear 95 attached to the normal and reverse rotation shaft 67 as the repeat-adjusting change wheel and fix the spur gear interchangeably to the shaft 67 by a clamping member 114. In this case, a swinging piece 115 is mounted so that it can swing with the shaft 98 being as the center and the idle wheel 96 is rotatably mounted on the swinging piece 115 so that the idle wheel 96 can swing in the state where it is kept engaged with the fixed gear 97. In this manner, a repeat-adjusting change gear 95 having a suitable tooth number (diameter) is attached.

Referring to FIGS. 9 and 10-A to 10-C, a screen driving shaft 116 is mounted on the screen-driving connecting shaft 57 through the fine adjustment coupling, and the continuous rotation of the screen driving shaft 116 is converted to a reciprocative rotation of a normal and reverse rotation shaft 67 in the same manner as in the squeegee driving device 24 and the operations of the partially toothed wheels and cams are the same as those in the squeegee driving device 24. Accordingly, in the screen driving device 21 shown in FIGS. 9 and 10-A to 10-C, members having the same functions as those in the squeegee driving device are indicated by the same reference numerals as used hereinbefore in illustrating the squeegee driving device.

In the screen driving device 21 shown in FIGS. 9 and 10-A to 10-C, the reciprocative rotation of the shaft 67 in the normal and reverse directions can be performed by the same operations as shown in FIGS. 5-A to 5-E and 6. A repeat-adjusting change gear 117 is exchangeably attached to the normal and reverse rotation shaft 67 for driving the screen by means of a clamping mechanism 117'. The reciprocative rotation of the shaft 67 in the normal and reverse directions is transmitted to a screen driving shaft 120 through a fixed gear 119 engaged with the change gear 117 through an idle gear 118. The free gear 118 is pivoted on a swinging piece 121 capable of swinging with the shaft 120 being as the center, and the fixed gear 119 is always engaged with the change gear 117 irrespective of the tooth number (diameter) of the repeat-adjusting change gear 117. In order to adjust this engagement between the fixed gear 119 and the change gear 117, an arc-like long pin hole 122 is formed on the swinging piece 121, and a stud bolt 123 is appropriately inserted into the hole 122 to perform the positional adjustment and fixation (see FIG. 10-C).

A pinion 124 is fixed to the screen driving shaft 120 and is engaged with a rack 125 attached to one end of the above-mentioned connecting rod 23 for reciprocative driving of the screen. In this arrangement, the reciprocative rotation of the screen driving shaft 67 in the normal and reverse directions is transmitted as a horizontal reciprocative movement to the screen-driving connecting rod 23, and as a result, all the operations for reciprocative driving of the screen can be performed precisely according to the mechanically controlled program.

In the interior of the screen driving device 21, the belt-driving connecting shaft 18 and the belt-driving output shaft 19 are disposed in such a manner that they rectangularly cross each other, and they are engaged with each other through bevel gears 126 attached to both the shafts 18 and 19, respectively.

In the automatic screen printing machine of the present invention illustrated in the accompanying drawings, common main structures and members are adopted in the screen driving device 21 and the squeegee driving device 24, and by this arrangement, various advantages can be attained in the present invention. For example, since the main members can be used commonly in both the driving devices 21 and 24, the maintenance and assembling of these members can be remarkably facilitated and the printing machine as a whole can be maintained very easily.

As is illustrated in FIGS. 1-A and 1-B, the squeegee driving device 24 and the screen driving device 21 are disposed substantially symmetrically on both the sides of the machine frame. In order to drive a pair of connecting rods 23 disposed on both the side of the flat screen frame 8, as illustrated in FIGS. 4-A and 4-B, also in the squeegee driving device 24, a pinion 124 fixed to the screen driving shaft 120 is arranged so that it is engaged with a rack 125 fixed to one end of the connecting rod 23.

Referring now to FIG. 11 illustrating the screen frame supporting mechanism, a screen supporting mechanism 127 is mounted on the guide rail 100 disposed in the lengthwise direction of the machine frame in common with the above-mentioned squeegee supporting mechanism through a slide bearing 128 so that the mechanism 127 can be reciprocated in the horizontal direction. A plurality of such screen supporting mechanisms 127 are disposed to correspond to the respective flat screen frames 8 and they are fixed at prescribed intervals to the connecting rod 23 extending in the lengthwise direction of the machine frame 2.

The screen frame 8 is fixed to a supporting rod 129 extending in a direction rectangular to the direction of advance of the material to be printed, and brackets 130 mounted on both the ends of this supporting rod 129 are supported by a supporting bracket 131 of the screen supporting mechanism. In order to adjust the positions of the supporting rod 129 and in turn the screen frame 8 minutely in the lengthwise direction of the machine, a roller 132 for setting the position in the horizontal direction (the widthwise direction) and a roller 133 for setting the position in the vertical direction are mounted on the supporting bracket 131 through eccentric shafts 134 and 135, respectively. Accordingly, both the brackets 130 disposed on both the ends of the supporting rod 129 are supported so that they can move in the lengthwise direction of the machine frame while their positions in both the widthwise and vertical directions are being controlled by these rollers 132 and 133.

A phase-adjusting driving shaft 136 extending in the widthwise direction of the machine frame is disposed above the screen supporting mechanism 127, and this driving shaft 136 is driven and rotated in either the normal direction or the reverse direction by a phase-adjusting geared motor 137. An adjustment screw 138 extending in a direction rectangularly crossing the extension direction of the phase-adjusting driving shaft 136, namely in the lengthwise direction of the machine frame, is disposed and engaged with the phase-adjusting driving shaft 136 through bevel gears 139 fixed to the screw 138 and the shaft 136, respectively. The bracket 130 has a portion 140 extending upwardly in the vertical direction, and a female screw of this vertical portion 140 is engaged with the adjustment screw 138. When the phases among screens are adjusted by using the above arrangement, the phase-adjusting geared motor 137 is driven and rotated in the normal or reverse direction to rotate the adjustment screw 138 in an optional direction, whereby the screen supporting rod and the screen frames 8 are advanced or retreated with respect to the lengthwise direction of the machine and a precise positional adjustment can be accomplished. In the embodiment specifically illustrated in FIG. 11, the rotation of the screw 138 is performed by the motor. Of course, in the present invention, the phase adjustment can be performed manually by means of a dial mounted on the adjustment screw 138.

According to the present invention, the horizontal reciprocative movements of the screen and squeegee are performed according to the mechanically controlled program. In the present invention, also the lifting and lowering operations for contacting the material 1 to be printed with the screen 9 at the printing step and separating the material 1 from the screen 9 during the non-printing period are performed according to the mechanically controlled program.

In the embodiment specifically illustrated in FIGS. 1-A and 1-B, the receiving roller 5 acting as the supporting and transporting mechanism for the material 1 to be printed is lifted and lowered with the vertical movement of the lifting rail 13. As drive means for this lifting rail 13, there is used, for example, a mechanism including a partially toothed driving wheel, a partially toothed lifting wheel and a lifting cam pivoted on the lifting wheel. In this case, it is preferred that by intermittent engagement between both the partially toothed wheels, the receiving roller be lifted and lowered and the receiving roller be restrained at the elevated or lowered position when the above engagement is released.

Referring now to FIGS. 12-A and 12-B illustrating the lifting device 33, a lifting input shaft 34 is connected to an input shaft of a lifting timing-adjusting device 35 through a universal joint 141. This lifting timing adjusting device 35 consists essentially of a known differential gear device, and a worm 143 is fixed to its output shaft 142. A worm gear 144 to be engaged with this worm 143 is disposed, and a partially toothed driving wheel 145 is pivoted on this worm gear 144.

The partially toothed driving wheel 145 comprises a toothed large-diameter portion 146, a non-toothed smooth small-diameter portion 147 and stepped shoulders **148*a* and 148*b* formed in two boundary portions between the portions 146 and 147. A lifting driving shaft 150 is disposed in parallel to a shaft 149 of the wheel 145, and a partially toothed lifting wheel 151 is mounted on this shaft 150. This partially toothed lifting wheel 151 comprises small-diameter portions 152*a* and 152*b* having teeth to be engaged with the teeth of the partially toothed driving wheel 145 and tail portions 153*a* and 153*b* extending in the radial direction outwardly over the small-diameter portions 152*a* and 152*b*. The top ends of the tail portions 153*a* and 153*b* are formed into cancave faces to be engaged with the circumferential face of the small-diameter portion 147 of the driving wheel 145. The number of teeth on the large-diameter portion 146 of the driving wheel 145 is equal to the number of teeth on the small-diameter portions 152***a* and 152*b* of the lifting wheel 151.

A lifting cam 154 is fixed to the shaft 150 to which the partially toothed lifting wheel 151 is fixed. Preferably, a lifting cam device 33' is disposed on the side opposite to the side where the lifting device 33 is disposed and a lifting cam 154' fixed to a shaft 150' is rotatably contained in this lifting cam device 33'. The shaft 150 is connected to the shaft 150' through a connecting shaft 36, and a pair of confronting lifting cam plates 154 and 154' are rotated in the same phase.

A cam groove 155 is formed on the lifting cam plate 154 (154') to set the elevated and lowered positions of the lifting rail 13 and controlling the operation pattern at lifting and lowering. A cam roller 156 is engaged with the cam groove 155, and the cam roller 156 is fixed to one end of a lifting connecting rod 37 extending in the lengthwise direction of the machine frame. This rod 37 extends so that it passes through a plurality of pinion-rack mechanisms 38 and the rod 37 has racks 157 in respective mechanisms 38 which are engaged with pinions 158. Other pinion 159 is pivoted on each pinion 158, and a rack 160 extending in the vertical direction from the lifting rail 13 is engaged with the latter pinion 159. In this arrangement, when the lifting connecting rod 37 is slided in the lengthwise direction of the machine, the lifting rail 13 is moved in the vertical direction through the pinion-rack mechanisms 38.

The rotation of the lifting input shaft 34 is transmitted to the partially toothed driving wheel 145 through the output shaft of the differential gear device 35, the worm 143 and the worm gear 144, and the wheel 145 is rotated continuously in one direction (in the counter-clockwise direction in the drawings). In FIG. 12-B illustrating the state where the lifting rail 13 is stopped at the lowered position (the lowermost position indicated by line *a-b* in FIG. 6), namely the non-printing state, the tail 153*a* of the partially toothed lifting wheel 151 is engaged with the circumference of the small-diameter portion 147 of the partially toothed driving wheel 145, and therefore, the lifting cam 154 is stopped in the restrained state, while the cam roller 156 is engaged with the lowermost position-setting part of the cam groove 155.

When the partially toothed driving wheel 145 is further rotated in the counter-clockwise direction, the stepped shoulder 148*a* of the wheel 145 falls in engagement with the tail portion 153*a* of the partially toothed lifting wheel 151. Since a notch allowing the rotation of the tail portion 153*a* is formed on the stepped shoulder 148*a*, the restrainment by the tail portion 153*a* is released and the tail portion 153*a* is pressed by the stepped shoulder 148*a*, whereby the teeth 146 are engaged with the teeth 152*a* and the partially toothed lifting wheel 151 is driven and rotated in the clockwise direction. With this rotation of the wheel 151, also the lifting cam 154 is rotated in the clockwise direction to move the cam roller 156 and in turn the connecting rod 37 upwardly in the drawings. Thus, the lifting rail 13 is lifted up from the lowermost position through the medium position to the uppermost position according to an operation pattern indicated by curve *b-c-d-e-f-g* in FIG. 6.

After the partially toothed lifting wheel 151 and in turn the lifting cam 154 make a ½ rotation in the clockwise direction, the other tail portion 153*b* is engaged with the circumference of the small-diameter portion 147 through the notch of the stepped shoulder 148*b* of the driving wheel 145, whereby the lifting wheel 151 and cam 154 are stopped and restrained, and the lifting rail 13 is stopped at the uppermost position (line *g-h* in FIG. 6).

When the partially toothed driving wheel 145 is rotated in the counter-clockwise direction and the stepped shoulder 148*a* falls in engagement with the tail portion 153*b* of the partially toothed lifting wheel 151, in the same manner as described above with respect to the tail portion 153*a*, the lifting wheel 151 and lifting cam 154 are released from the restrainment and rotated in the clockwise direction, whereby the cam roller 156 and the connecting rod 37 are moved downwardly and the lifting rail 13 is lowered from the uppermost position through the medium position to the lowermost position according to an operation pattern indicated by curve *h-i-j-k-l-a* in FIG. 6.

Then, the tail portion 153*a* of the partially toothed lifting wheel 151 is engaged with the circumference of the small-diameter portion 147 through the notch of the stepped shoulder 148*b*, whereby the lifting wheel 151 and lifting cam 154 are restrained and the lifting rail 13 is stopped at the lowermost position.

When partially toothed wheels which are intermittently driven and restrained are used in combination with lifting cams in a manner as described above as the lifting means in the flat screen printing apparatus, there are attained various advantages.

For example, as is seen from FIG. 6, the time for stopping at the elevated or lowered position can be made sufficiently longer as compared with the time for lifting or lowering, and operations of the lifting rail, such as lifting, stopping at the elevated position, lowering and stopping at the lowered position, can be performed at good timings without deviation according to the strictly controlled program.

The shape of the cam groove 155 of the lifting cam 154 may be changed optionally according to a desired pattern of the lifting and lowering movement. However, in view of the time necessary for the operation for squeeging the printing paste or ink or for returning the printing paste or ink to the original position by a doctor blade, it is preferred that the shape of the cam groove 155 be arranged so that the lifting rail 13 is stopped at an intermediate position for a very short time as illustrated in FIG. 6. In the apparatus shown in FIGS. 12-A and 12-B, the pattern of the lifting and lowering movement can easily be controlled in such manner.

When the vertical movement of the receiving roller 5 is performed by using the lifting rail 13, in order to control strictly the position of the receiving roller 5 in the vertical direction and scan and move the receiving roller 5 always in the state coinciding with the squeegee member, it is preferred that a lifting roller be disposed so that it can move along the lifting rail 13 in the direction of the movement of the material to be printed and that these receiving roller and lifting roller be rotatably mounted on a lever which is disposed on the above-mentioned supporting mechanism for the squeegee member so that it can swing.

In view of the facilitation of the printing operation, it is preferred that in the supporting mechanism for the squeegee member, the squeegee member and the doctor blade be arranged so that they are moved up and down alternately and the squeegee member and the doctor blade be interlocked with the receiving roller so that when the receiving roller is at the elevated position, the squeegee member is at the lowered position and when the receiving roller is at the lowered position, the doctor blade is at the lowered position.

Referring to FIGS. 7-A and 7-B again, a bracket 161 is disposed in the lower portion of the squeegee supporting mechanism 11 and a lever 162 is mounted on the bracket 161 so that the lever 162 can be swung with a shaft 163 being as the center. The lever 162 has a fan-like or triangular shape and a lifting roller 164 is rotatably mounted in the lower corner of the lever 162 through a suitable bearing mechanism. In the other corner of the lever 162, namely in the portion above the line connecting the shaft 163 and the roller 164, a supporting shaft 165 for the receiving roller is disposed, and the receiving roller 5 is rotatably mounted on this supporting shaft 165 through a bearing.

The shaft 163 connecting the lever 162 to the squeegee supporting mechanism 11 is preferably located at a position deviated into the direction of the printing course (toward the left in FIG. 7-B) from the line connecting the receiving roller supporting shaft 165 and the shaft of the lifting roller 164. By this arrangement, the vertical movement of the receiving roller 5 during the printing course can be performed smoothly. For this purpose, the program shown in FIG. 6 is set so that the time for advance of each of the screen and squeegee member (the time for the movement during the printing course) is made longer than the time for retreat of each of these members while the time for stopping of the lifting rail at the uppermost position is made equal to the time for stopping of the lifting rail at the lowermost position and that at the initial stage of the movement during the printing course the material to be printed is contacted with the screen and at the terminal stage of the movement during the printing course the material is separated from the screen. The receiving roller 5 supports on the upper side thereof the endless belt and guide rollers 166 are disposed on both the ends of the receiving roller 5 to regulate the position of the endless belt with respect to the widthwise direction. The lifting roller 164 is always placed on the lifting rail 13.

In the above-illustrated arrangement, when the squeegee supporting mechanism 11 fixed to the connecting rod 102 is reciprocated along the guide rail in the lengthwise direction of the machine frame, the lifting roller 164 is turned reciprocatively on the surface of the lifting rail 13 to reciprocate on the level corresponding to the position of the lifting rail 13 the receiving roller 5 which supports the endless belt 6. When the lifting rail 13 is lifted or lowered by the above-mentioned lifting device 33, according to the displacement of the lifting rail 13, the lever 162 is turned in the counter-clockwise direction or clockwise direction, whereby the receiving roller 5 is lifted or lowered. When the receiving roller 5 is at the uppermost position, namely at the printing step, the positions of the flat screen 9, the material 1 to be printed and the endless belt 6 are set in the gripped state by the top end of the squeegee member 10 and the supporting face of the receiving roller 5.

Referring to FIG. 7-B, a squeegee holder attachment 167 and a doctor blade holder attachment 168 are mounted on the squeegee supporting mechanism 11 so that they can be vertically moved. A squeegee holder 104 is fixed to the attachment 167 so that its position in the vertical direction can be adjusted by a squeegee pressure adjusting screw 106, and a doctor blade holder 169 is fixed to the attachment 168 so that its position in the vertical direction can be adjusted by a blade pressure adjusting screw 170. The squeegee attachment 167 is fixed to a rack 171 and the doctor blade attachment 168 is fixed to a rack 172. A pinion 173 to be engaged with these racks 171 and 172 is disposed in the interior of the supporting mechanism 11, and a spur gear 174 is fixed to this pinion 173. A shaft 176 is rotatably disposed in parallel to a shaft 175 of the pinion 173, and a fan-shaped gear 177 to be engaged with the spur gear 174 is fixed to the external end portion of the shaft 176, while a lever 178 is fixed to the internal end portion of the shaft 176.

A connecting rod 181 is disposed between the end of the receiving roller supporting shaft 165 and the end of the lever 178 through ball joints 179 and 180, respectively. When the receiving roller 5 is lifted or lowered, the lever 178 is turned in the counter-clockwise or clockwise direction by the connecting rod 181 and with turning of the lever 178, the pinion 173 is rotated in the clockwise direction or the counter-clockwise direction, whereby the squeegee holder 104 is lowered and the doctor blade holder 169 is lifted, or the squeegee holder 104 is lifted and the doctor blade holder 169 is lowered.

Thus, with the vertical movement of the lifting rail 13, the vertical movement of the receiving roller and the exchange between the squeegee member 10 and the doctor blade 12 can be performed smoothly. More specifically, during the printing operation, the squeeging operation can be accomplished by the lower end of the squeegee member 10 and the receiving roller 5 in the state where the screen 9 is contacted with the material 1 to be printed, and during the non-printing period, the screen 9 is separated from the material 1 and the printing paste or ink on the screen 9 is returned.

In the embodiment specifically illustrated in FIGS. 7-A and 7-B, the pinion 173 is turned by the lever 178, and the vertical movements of the squeegee member 10 and the doctor blade 12 are performed directly mechanically. Even when the vertical movements of the squeegee member 10 and doctor blade 12 are performed by using, for example, a fluid mechanism such as an air cylinder and the change-over operation of a change lever of the fluid mechanism is performed by the lever 178, the exchange between the squeegee member 10 and the doctor blade 12 can be performed smoothly.

According to the automatic screen printing method of the present invention, a material to be printed is fed continuously at a constant speed in the supported state to the printing operation zone, the flat screen and squeegee member are reciprocated to effect the printing operation, at this printing step the flat screen and squeegee member are driven by using a common drive source, and the operations of the supporting mechanism, the flat screen and the squeegee member are performed according to a mechanically controlled program. By these features there are attained various advantages in the present invention. For example, with respect to each of operations such as the reciprocative movement of the screen, the reciprocative movement of the squeegee and the relative vertical movements of the material to be printed and the screen, setting of positions and control of driving and stopping can always be performed precisely and assuredly according to a prescribed program. Further, by performing these driving operations by using a common drive source, the timings for all the operations in the printing machine can be controlled precisely and assuredly.

In the conventional automatic screen printing machines, when the screen or squeegee member is reciprocated, generation of mechanical shocks cannot be avoided at acceleration, speed reduction or stopping, and control of timings for various operations becomes difficult and if any special means is disposed to avoid such mechanical shocks, the above timing control is often made difficult by provision of such special means. In contrast, according to the present invention, by performing the above operations of acceleration, speed reduction or stopping positively according to the mechanically controlled program, generation of mechanical shocks and deviation of timings can be effectively prevented.

Moreover, according to the present invention, since such operations as the reciprocative movement of the screen, the reciprocative movement of the squeegee and relative vertical movements of the material to be printed and the screen are mechanically controlled, timings for these operations can be adjusted very easily and assuredly, and once these timings are set according to the mechanically controlled program, even if the operation conditions or printing conditions are changed, re-adjustment of the timings is unnecessary. This is a great operational advantage from the industrial viewpoint.

Still further, in the present invention, since the reciprocative movements of the screen and the squeegee member and the relative vertical movements of the material to be printed and the screen are performed according to the mehcanically controlled program, the repeat length of the screen can also be performed very easily. In the lifting device shown in FIGS. 12-A and 12-B, an arrangement is made such that the vertical movement of the lifting frame 13 and in turn that of the receiving roller 5 are always effected at prescribed intervals. In this embodiment, the repeat length of the screen is changed by changing the feed speed of the material to be printed. More specifically, when it is intended to prolong the repeat length, the feed rate of the material to be printed is increased, and when it is intended to shorten the repeat length, the feed rate of the material to be printed is reduced.

Accordingly, the repeat length of the screen can easily be adjusted by adjusting the transporting speed of the supporting and transporting mechanism and the scanning speeds of the flat screen and squeegee member. For this adjustment, the repeat-adjusting change gear 41 of the endless belt driving device 15 shown in FIGS. 2-A and 2-B, the length-adjusting change wheel 107 of the squeegee driving system shown in FIG. 8 (or the gear 95 of the squeegee driving device 24 shown in FIG. 3) and the repeat length-adjusting change gear 117 of the screen driving device 21 shown in FIG. 9 are simultaneously exchanged. In this manner, according to the present invention, the repeat length of the printed pattern can optionally be adjusted and control of positions of the respective members and control of the respective operations can be performed precisely and assuredly irrespective of this adjustment of the repeat length. Of course, if a motor equipped with a speed change gear is used instead of the driving motor 14 in the embodiment shown in FIG. 1-A, even when the repeat length is changed, the feed speed of the material to be printed can always be kept constant.

In the present invention, various modifications can be made within the spirit of the present invention. For example, although in the foregoing embodiment the receiving roller 5 acting as the supporting and transporting mechanism is vertically moved by using the lifting rail 13, it is possible to perform the printing operation also by reciprocating the flat screen frame 8 and the squeegee supporting mechanism 11 on the lifting frame and vertically moving this lifting frame by using the above-mentioned lifting device 33.

Any of screens that are used in conventional screen dye printing methods and screen printing methods can be used in the present invention. In the present invention, since the printing operation is conducted while the material to be printed is continuously fed, it is possible to print a pattern on the entire surface of a wall paper or carpet, and there is attained an advantage that screens much larger than the screens used in the conventional printing methods can be used optionally, and even when these large screens are employed, deviation of the pattern or phase can be effectively prevented.

Not only an ordinary squeegee composed of an elastic blade but also a squeegee composed of a rigid block and a roller-type squeegee can be used as the squeegee member in the present invention. It is possible to use a roller having an electromagnetic mechanism built therein as the receiving roller 5 and a roller squeegee composed of a magnetic substance as the squeegee member.

What I claim is:

1. In an automatic screen printing method comprising feeding a material to be printed on a supporting and transporting member, transporting said material continuously at a constant speed in the lengthwise direction through a printing operation zone, moving a flat screen along said material at the same speed in the same direction as said material, contacting said material with the flat screen, scanning a squeegee member disposed above and in contact with the flat screen from one end of the flat screen to the other end thereof to print said material, releasing the contact between said material and the flat screen just before the squeegee member arrives at the other end of the flat screen, moving the squeegee member and the flat screen in a direction reverse to the moving direction for the printing operation to return them to the original printing-starting positions, respectively, and repeating the foregoing operations, the improvement which comprises driving said supporting and transporting member, said flat screen and said squeegee member by one common drive source, driving said flat screen and said squeegee member in scanning reciprocative movements comprising a sequence of accelerated advance, constant speed advance, reduced speed advance, stopping, accelerated retreat, constant speed retreat, reduced speed retreat and stopping, through a gear mechanism and a cam mechanism which are driven synchronously with each other by said common drive source, while each of the constant speed movements of said flat screen and said squeegee member is controlled by said gear mechanism and each of speed reduction, stopping and acceleration of the flat screen and the squeegee member is controlled by said cam mechanism, contacting said material with the flat screen in the initial stage of the constant speed advance of the flat screen and the squeegee member, and releasing the contact between said material and the screen in the terminal stage of the constant speed advance of the flat screen and the squeegee member.

2. An automatic screen printing method according to claim 1 wherein each of said flat screen and said squeegee member is reciprocated through an output shaft rotating reciprocatively in the normal and reverse directions; engaging a first partially toothed wheel connected to said output shaft with a second partially toothed wheel driven in the normal direction by said common drive source and engaging said first partially toothed wheel with a third partially toothed wheel driven in the reverse direction by said common drive source, said last two-mentioned steps being performed alternately and repeatedly, whereby said output shaft is rotated reciprocatively in the normal and reverse directions; and engaging a cam follower fixed to said shaft with a cam driven and rotated by said common drive source synchronously with said first and second partially toothed wheels at the time of the start of the engagement between the first and second or first and third partially toothed wheels and at the time of the completion of the engagement between the first and second or first and third partially toothed wheels, whereby said flat screen and said squeegee member are accelerated at the time of the start of their movements, and the speeds of said flat screen and said squeegee member are reduced and their movements are stopped at the time of the completion of their movements.

3. An automatic screen printing method according to claim 1 wherein the flat screen is caused to fall in contact with the material to be printed by lifting up the transporting member supporting the material to be printed and separating the flat screen from the material by lowering said transporting member; intermittingly driving a lifting cam mechanism by said common drive source and intermittently restraining said lifting cam mechanism to control the position and vertical movement of said transporting member; whereby by rotation of said cam mechanism said transporting member is lifted up or lowered and by restraint of said cam mechanism and transporting member is held at the elevated position or lowered position.

4. An automatic screen printing method comprising feeding a material to be printed into a printing operation zone, transporting in the supported state the material to be printed continuously at a constant speed in the lengthwise direction, scanning a flat screen having a certain length in the longitudinal direction thereof along the material to be printed, during a part of said scanning said screen moves at the same speed in the same direction as the material to be printed, contacting the material to be printed, which is being transported on a supporting and transporting member, with the flat screen, reciprocatively scanning a squeegee member disposed above said flat screen from one end of the flat screen to the other end to thereby print said material, a portion of said scanning being at a constant speed, releasing the contact between the flat screen and the material just before the squeegee member arrives at the other end of the flat screen, moving the squeegee member and the flat screen in a direction reverse to the moving direction for the printing operation to return said squeegee member and said flat screen to the original printing-starting positions, and repeating the foregoing operations, wherein said supporting and transporting member, said flat screen and said squeegee member are driven by one common drive source and said operations of said supporting and transporting member, said flat screen and said squeegee member are performed according to a mechanically controlled program;

wherein each of the scanning movements of said flat screen and said squeegee member is controlled through a gear mechanism and a cam mechanism which are driven synchronously with each other by said common drive source, each of the constant speed scanning movements of said flat screen and said squeegee member is performed by said gear mechanism and speed reduction, stopping and acceleration of each of the scanning movements of said flat screen and said squeegee member are performed through said cam mechanism;

wherein each of said flat screen and said squeegee member is reciprocated through an output shaft rotating reciprocatively in the normal and reverse directions; engaging a first partially toothed wheel connected to said output shaft with a second partially toothed wheel driven in the normal direction by said common drive source and engaging said first partially toothed wheel with a third partially toothed wheel driven in the reverse direction by said common drive source, said last two-mentioned steps being performed alternately and repeatedly, whereby said output shaft is rotated reciprocatively in the normal and reverse directions; and engaging a cam follower fixed to said shaft with a cam driven and rotated by said common drive source synchronously with said first and second partially toothed wheels at the time of the start of the engagement between the first and second or first and third partially toothed wheels and at the time of the completion of the engagement between the first and second or first and third partially toothed wheels, whereby said flat screen and said squeegee member are accelerated at the time of the start of their scanning movements, and the speeds of said flat screen and said squeegee member are reduced and their scanning movements are stopped at the time of the completion of their scanning movements;

wherein the flat screen is caused to fall in contact with the material to be printed by lifting up the transporting member supporting the material to be printed and separating the flat screen from the material by lowering said transporting member; intermittingly driving a lifting cam mechanism by said common drive source and intermittently restraining said lifting cam mechanism to control the position and vertical movement of said transporting member; wherein a partially toothed wheel driven and rotated by said common drive source is intermittently engaged at prescribed intervals with another partially toothed wheel to which the lifting cam mechanism is pivoted, whereby said lifting cam mechanism is rotated to lift up or lower said transporting member, and by release of the engagement between said partially toothed wheels, said other partially toothed wheel is restrained to hold said supporting member at the elevated position or lowered position.

5. An automatic screen printing machine comprising a transporting mechanism for supporting thereon a material to be printed and transporting it to a printing operation zone, a flat screen disposed above a running passage for the material to be printed in the printing operation zone, a squeegee member disposed above said flat screen to squeeze out a printing paste or ink onto the material to be printed through said flat screen, a transporting mechanism driving mechanism for driving said transporting mechanism to feed the material to be printed into the printing operation zone continuously at a certain speed, a flat screen driving mechanism for reciprocating a screen frame supporting said flat screen along the running passage for the material to be printed and making the moving speed and direction of said screen frame in accord with that of the material to be printed at the printing step, a squeegee driving mechanism for reciprocating said squeegee member along said flat screen and scanning said squeegee member from one end of said flat screen to the other end at the printing step, and a lifting mechanism for causing the material to be printed to fall in contact with said flat screen at the printing step and separating the material from said flat screen during the non-printing period, wherein said transporting mechanism driving mechanism, flat screen driving mechanism and squeegee driving mechanism are mechanically connected to a common drive source, each of said flat screen driving mechanism and squeegee driving mechanism includes a gear mechanism and a cam mechanism which are synchronously driven by said common drive source, and each of said flat screen and said squeegee member is driven at a constant speed through their respective gear mechanism and operations of speed reduction, stopping and acceleration of said flat screen and said squeegee member are performed through said cam mechanism;

wherein each of the gear mechanisms of said flat screen driving mechanism and said squeegee driving mechanism includes a first partially toothed wheel connected to an output shaft, a normal direction-driven, second partially toothed wheel which is engaged with said first partially toothed wheel and driven and rotated in one direction and a reverse direction-driven, third partially toothed wheel which is engaged with said first partially toothed wheel and driven and rotated in a direction reverse to the rotation direction of said second partially toothed wheel, said first, second and third partially toothed wheels being mounted such that said first partially toothed wheel is engaged alternately with said second partially toothed wheel and with said third partially toothed wheel; and each of the cam mechanisms of said flat screen driving mechanism and said squeegee driving mechanism comprises a cam follower fixed to the output shaft and first and second cams, each of which is driven and rotated at a certain speed and is capable of being engaged with said cam follower, each of said cam followers and their associated said first and second cams are mounted such that at the time of termination of the normal rotation of the output shaft by said normal direction-driven, second partially toothed wheel, the cam follower is engaged with a cam groove of said first cam to reduce the speed of the normal rotation of the output shaft, stop the output shaft and accelerate the output shaft to turn in the reverse direction, and at the time of termination of the reverse rotation of the output shaft by said reverse direction-driven, third partially toothed wheel, the cam follower is engaged with a cam groove of said second cam to reduce the speed of the reverse rotation of the output shaft, stop the output shaft and accelerate the output shaft to turn in the normal direction.

6. An automatic screen printing machine comprising a transporting mechanism for supporting thereon a material to be printed and transporting it to a printing operation zone, a flat screen disposed above a running passage for the material to be printed in the printing operation zone, a squeegee member disposed above said flat screen to squeeze out a printing paste or ink onto the material to be printed through said flat screen, a transporting mechanism driving mechanism for driving said transporting mechanism to feed the material to be printed into the printing operation zone continuously at a certain speed, a flat screen driving mechanism for reciprocating a screen frame supporting said flat screen along the running passage for the material to be printed and making the moving speed and direction of said screen frame in accord with that of the material to be printed at the printing step, a squeegee driving mechanism for reciprocating said squeegee member along said flat screen and scanning said squeegee member from one end of said flat screen to the other end at the printing step, and a lifting mechanism for causing the material to be printed to fall in contact with said flat screen at the printing step and separating the material from said flat screen during the non-printing period, wherein said transporting mechanism driving mechanism, flat screen driving mechanism and squeegee driving mechanism are mechanically connected to a common drive source, each of said flat screen driving mechanism and said squeegee driving mechanism includes a gear mechanism and a cam mechanism which are synchronously driven by said common drive source and each of said flat screen and said squeegee member is driven at a constant speed through their respective gear mechanism and operations of speed reduction, stopping and acceleration of said flat screen and said squeegee member are performed through said cam mechanisms;

wherein the printing machine further comprises a receiving roller disposed in the printing operation zone below the running passage for the material to be printed, which is lifted and lowered by said lifting mechanism; said lifting mechanism includes a gear mechanism for driving intermittently a lifting cam mechanism by utilizing the driving power of said common drive source and restraining intermittently said lifting cam mechanism; and said lifting cam mechanism and said receiving roller are mounted such that the receiving roller is lifted and lowered by rotation of said cam mechanism and said receiving roller is held at the elevated position or lowered position by restraint of said cam mechanism; wherein said gear mechanism in said lifting mechanism includes a first partially toothed wheel driven and rotated by said common drive source and a second partially toothed wheel to which a lifting cam is fixed; said first partially toothed wheel includes a toothed circumferential portion and a non-toothed circumferential portion and said second, partially toothed wheel includes at least one toothed circumferential portion and at least one projected portion having a concave face to be engaged with the non-toothed smooth circumferential portion of said first partially toothed wheel; and by engagement between the teeth of said first partially toothed wheel and the teeth of said second partially toothed wheel, said second partially toothed wheel is driven and rotated, and by engagement of the projected portion of said second partially toothed wheel with the non-toothed smooth circumferential portion of said first partially toothed wheel, the second partially toothed wheel is restrained.

* * * * *